US010308013B1

(12) United States Patent
Baumer et al.

(10) Patent No.: US 10,308,013 B1
(45) Date of Patent: Jun. 4, 2019

(54) CONTROLLING WAVEFORMS TO REDUCE CROSS-TALK BETWEEN INKJET NOZZLES

(71) Applicant: Eastman Kodak Company, Rochester, NY (US)

(72) Inventors: Michael Frank Baumer, Dayton, OH (US); Chang-Fang Hsu, Beavercreek, OH (US); Randy Lee Fagerquist, Fairborn, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 9 days.

(21) Appl. No.: 15/831,955

(22) Filed: Dec. 5, 2017

(51) Int. Cl.

| | |
|---|---|
| ***B41J 2/085*** | (2006.01) |
| ***B41J 2/105*** | (2006.01) |
| ***B41J 2/02*** | (2006.01) |
| ***B41J 2/03*** | (2006.01) |
| ***B41J 2/025*** | (2006.01) |
| ***B41J 2/09*** | (2006.01) |
| ***B41J 2/115*** | (2006.01) |
| ***B41J 2/075*** | (2006.01) |
| ***B41J 2/14*** | (2006.01) |
| ***B41J 2/095*** | (2006.01) |
| ***B41J 2/08*** | (2006.01) |
| ***B41J 2/07*** | (2006.01) |

(52) U.S. Cl.
CPC ..... *B41J 2/02* (2013.01); *B41J 2/025* (2013.01); *B41J 2/03* (2013.01); *B41J 2/07* (2013.01); *B41J 2/075* (2013.01); *B41J 2/08* (2013.01); *B41J 2/085* (2013.01); *B41J 2/09* (2013.01); *B41J 2/095* (2013.01); *B41J 2/105* (2013.01); *B41J 2/115* (2013.01); *B41J 2/14056* (2013.01); *B41J 2002/022* (2013.01); *B41J 2002/032* (2013.01); *B41J 2002/033* (2013.01)

(58) Field of Classification Search
CPC ..... B41J 2/03; B41J 2/07; B41J 2/075; B41J 2/08; B41J 2/085; B41J 2/09; B41J 2/095; B41J 2/105; B41J 2/115; B41J 2/14056; B41J 2002/022; B41J 2002/032; B41J 2002/033
See application file for complete search history.

(56) References Cited

U.S. PATENT DOCUMENTS

| | | | |
|---|---|---|---|
| 3,761,941 | A | 9/1973 | Robertson |
| 3,836,912 | A | 9/1974 | Ghougasian |
| 3,878,519 | A | 4/1975 | Eaton |
| 3,949,410 | A | 4/1976 | Bassous et al. |
| 4,616,234 | A | 10/1986 | Wint |

(Continued)

*Primary Examiner* — Anh T Vo
(74) *Attorney, Agent, or Firm* — Kevin E. Spaulding

(57) ABSTRACT

An inkjet printhead includes two groups of interleaved nozzles. First and second sets of drop-formation waveforms are associated with the groups of nozzles to selectively cause portions of a liquid jet to break off into drops. A timing delay device time-shifts the second-group waveforms relative to those associated with the first-group waveforms. A charging-electrode waveform having portions with first and second potentials is provided to a charging electrode. The waveform energies of the second-group waveforms is larger than the waveform energies of the corresponding first-group waveforms so that printing drops break off from the liquid jets while the charging-electrode is at the first potential, and non-printing drops break off from the liquid jets while the charging-electrode is at the second potential.

21 Claims, 19 Drawing Sheets

(56) References Cited

U.S. PATENT DOCUMENTS

| | | | | |
|---|---|---|---|---|
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 7,249,828 | B2 | 7/2007 | Gelbart et al. | |
| 7,273,270 | B2 | 9/2007 | Katerberg | |
| 7,404,626 | B2 | 7/2008 | Piatt et al. | |
| 7,758,171 | B2 | 7/2010 | Brost | |
| 7,777,395 | B2 | 8/2010 | Xu et al. | |
| 7,828,420 | B2 | 11/2010 | Fagerquist et al. | |
| 7,938,516 | B2 | 5/2011 | Piatt et al. | |
| 8,087,740 | B2 | 1/2012 | Piatt et al. | |
| 8,182,068 | B2 * | 5/2012 | Panchawagh | B41J 2/03 347/44 |
| 8,382,259 | B2 | 2/2013 | Panchawagh | |
| 8,465,129 | B2 | 6/2013 | Panchawagh | |
| 8,469,495 | B2 | 6/2013 | Gerstenberger et al. | |
| 8,469,496 | B2 | 6/2013 | Panchawagh et al. | |
| 8,562,120 | B2 * | 10/2013 | Xie | B41J 2/09 347/44 |
| 8,585,189 | B1 | 11/2013 | Marcus et al. | |
| 8,651,632 | B2 | 2/2014 | Marcus | |
| 8,651,633 | B2 | 2/2014 | Marcus et al. | |
| 8,657,419 | B2 | 2/2014 | Panchawagh et al. | |
| 8,684,483 | B2 | 4/2014 | Grace et al. | |
| 8,696,094 | B2 | 4/2014 | Marcus et al. | |
| 8,714,676 | B2 | 5/2014 | Grace et al. | |
| 8,888,256 | B2 | 11/2014 | Marcus et al. | |
| 8,911,064 | B2 * | 12/2014 | Link | B41J 2/09 347/74 |
| 9,199,462 | B1 | 12/2015 | Baumer et al. | |
| 2011/0242169 | A1 | 10/2011 | Link et al. | |

* cited by examiner

CONTROLLING WAVEFORMS TO REDUCE CROSS-TALK BETWEEN INKJET NOZZLES

FIELD OF THE INVENTION

This invention pertains to the field of inkjet printing and more particularly to a method of controlling drop-formation waveforms to an array of nozzles to reduce printing artifacts.

BACKGROUND OF THE INVENTION

Continuous inkjet printing is a printing technology that is well suited for high speed printing applications, having high throughput and low cost per page. Recent advances in continuous inkjet printing technology have included thermally induced drop formation, which is capable of selectively altering the drop breakoff phase relative to a charging electrode waveform or selectively altering the velocity of a pair of drops (one of which is charged and the other uncharged) to cause them to merge, and electrostatic deflection of charged drops to separate the charged non-printing drops from the charged printing drops, as disclosed in U.S. Pat. No. 7,938,516 (Piatt et al.), U.S. Pat. No. 8,382,259 (Panchawagh et al.), U.S. Pat. No. 8,465,129 (Panchawagh et al.), U.S. Pat. No. 8,469,496 (Panchawagh et al.), U.S. Pat. No. 8,585,189 (Marcus et al.), U.S. Pat. No. 8,651,632 (Marcus et al.), U.S. Pat. No. 8,651,633 (Marcus et al.), and U.S. Pat. No. 8,657,419 (Panchawagh et al.), all commonly assigned. These advances have enabled the print resolution to be significantly improved while maintaining the throughput of the printer.

It has been found that under certain printing conditions, print artifacts can be produced. There is a need for a more effective means to prevent the formation of such print artifacts.

SUMMARY OF THE INVENTION

The present invention represents a method of printing, including: providing a liquid chamber having a plurality of nozzles disposed along a nozzle array direction, the plurality of nozzles including a first group of nozzles and a second group of nozzles, the nozzles of the first group being interleaved with the nozzles of the second group;

providing liquid under pressure in the liquid chamber, the pressure being sufficient to eject liquid jets through the plurality of nozzles;

providing a drop formation device associated with each of the plurality of nozzles;

providing a first set of drop-formation waveforms and a second set of drop-formation waveforms, wherein the first set of drop-formation waveforms and the second set of drop-formation waveforms each include:

one or more printing-drop drop-formation waveforms having a waveform period, which, when supplied to a drop formation device associated with a particular nozzle, modulate the liquid jet ejected from the particular nozzle to selectively cause portions of the liquid jet to break off into a pair of drops traveling along a path, the pair of drops including a small printing drop and a small non-printing drop; and one or more non-printing-drop drop-formation waveforms, which, when supplied to a drop formation device associated with a particular nozzle, modulate the liquid jet ejected from the particular nozzle to selectively cause a portion of the liquid jet to break off into a large non-printing drop traveling along the path, the large non-printing drop being larger than the small printing drop and the small non-printing drop, the non-printing-drop drop-formation waveforms having the same waveform period as the printing-drop drop-formation waveforms;

wherein each of the drop-formation waveforms provides an associated waveform energy when supplied to the corresponding drop formation device, and wherein the waveform energies associated with the drop-formation waveforms in the second set of drop-formation waveforms is larger than the waveform energies associated with the corresponding drop-formation waveforms in the first set of drop-formation waveforms;

providing input image data;

controlling the drop formation devices associated with each of the plurality of nozzles in response to the provided input image data, wherein the first group of nozzles are controlled with a sequence of drop-formation waveforms selected from the first set of drop-formation waveforms and the second group of nozzles are controlled with a sequence of drop-formation waveforms selected from the second set of drop-formation waveforms;

providing a timing delay device to time-shift the drop-formation waveforms used to control the drop formation devices associated with the second group of nozzles by a specified second-group time shift relative to the drop-formation waveforms used to control the drop formation devices associated with the first group of nozzles, wherein the second-group time shift is a fraction of the waveform period;

providing a charging device including:

a common charging electrode positioned in proximity to the liquid jets ejected through both the first and second groups of nozzles; and a charging-electrode waveform source providing a varying electrical potential between the charging electrode and the liquid jets according to a predefined periodic charging-electrode waveform, the charging-electrode waveform including a first portion providing a first electrical potential and a second portion providing a second electrical potential, wherein the charging-electrode waveform has the same waveform period as the drop-formation waveforms;

synchronizing the drop formation devices, the timing delay device, and the charging device, wherein the waveform energies associated with the drop-formation waveforms in the first and second sets of drop-formation waveforms and the second-group time shift are selected such that the small printing drops break off from the liquid jets during the first portion of the charging-electrode waveform to provide a first printing-drop charge state, and the small non-printing drops and the large non-printing drops break off from the liquid jets during the second portion of the charging-electrode waveform to provide a second non-printing-drop charge state;

providing a deflection device which causes the printing drops having the first printing-drop charge state to travel along a different path from the non-printing drops having the second non-printing-drop charge state; and intercepting the non-printing drops using an ink catcher while allowing the printing drops to travel along a path toward a receiver.

This invention has the advantage that the shifting the phase of the drop formation waveforms applied to interleaved sets of drop-formation devices reduces cross-talk artifacts, and appropriately modifying the waveform energies for the sets of drop-formation devices synchronizes the drop break-off times enabling electrostatic drop deflection using a common charging electrode.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

The example embodiments of the present invention are illustrated schematically and not to scale for the sake of clarity. One of the ordinary skills in the art will be able to readily determine the specific size and interconnections of the elements of the example embodiments of the present invention.

As described herein, exemplary embodiments of the present invention provide a printhead or printhead components typically used in inkjet printing systems. However, many other applications are emerging which use printheads to emit liquids (other than inks) that need to be finely metered and deposited with high spatial precision. As such, as described herein, the terms "liquid" and "ink" refer to any material that can be ejected by the printhead or printhead components described below.

Figure 1:
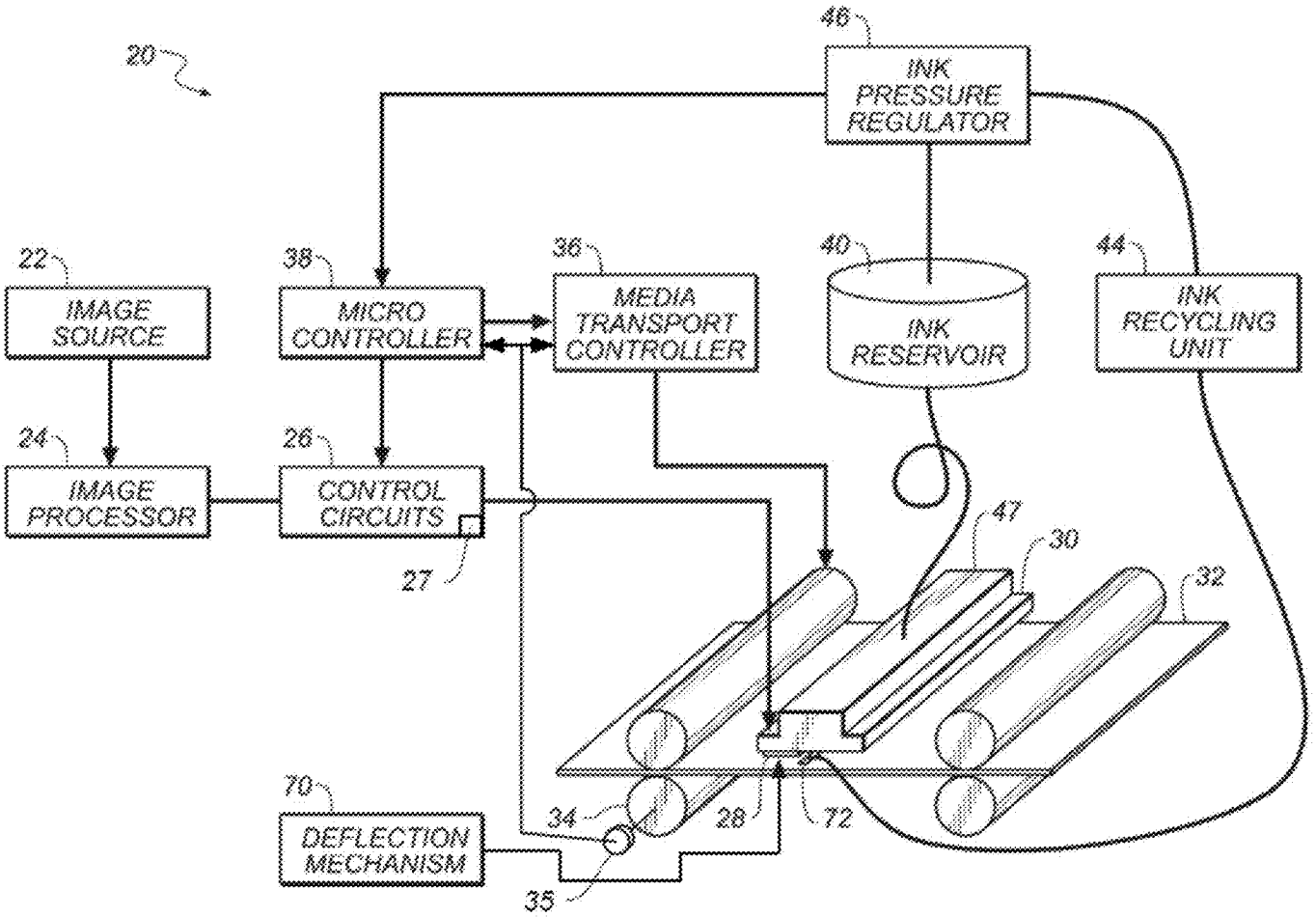
FIG. 1 (Prior Art)
FIG. 1 is a simplified block schematic diagram of an exemplary continuous inkjet system.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit (image processor) 24 which also stores the image data in memory. A plurality of drop-forming transducer control circuits 26 reads data from the image memory and apply time-varying electrical pulses to a drop-forming transducers 28 that are associated with one or more nozzles of a printhead 30. These pulses are applied at an appropriate time, and to the appropriate nozzles, so that drops formed from a continuous inkjet stream will form spots on a print medium 32 in the appropriate position designated by the data in the image memory.

Print medium 32 is moved relative to the printhead 30 by a print medium transport system 34, which is electronically controlled by a media transport controller 36 in response to signals from a speed measurement device 35. The media transport controller 36 is in turn is controlled by a microcontroller 38. The print medium transport system 34 shown in FIG. 1 is a schematic only, and many different mechanical configurations are possible. For example, a transfer roller could be used in the print medium transport system 34 to facilitate transfer of the ink drops to the print medium 32. Such transfer roller technology is well known in the art. In the case of page width printheads, it is most convenient to move the print medium 32 along a media path past a stationary printhead. However, in the case of scanning print systems, it is often most convenient to move the printhead along one axis (the sub-scanning direction) and the print medium 32 along an orthogonal axis (the main scanning direction) in a relative raster motion.

Ink is contained in an ink reservoir 40 under pressure. In the non-printing state, continuous inkjet drop streams are unable to reach print medium 32 due to an ink catcher 72 that blocks the stream of drops, and which may allow a portion of the ink to be recycled by an ink recycling unit 44. The ink recycling unit 44 reconditions the ink and feeds it back to the ink reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to the ink reservoir 40 under the control of an ink pressure regulator 46. Alternatively, the ink reservoir 40 can be left unpressurized, or even under a reduced pressure (vacuum), and a pump can be employed to deliver ink from the ink reservoir 40 under pressure to the printhead 30. In such an embodiment, the ink pressure regulator 46 can include an ink pump control system. The ink is distributed to the printhead 30 through an ink channel 47. The ink preferably flows through slots or holes etched through a silicon substrate of printhead 30 to its front surface, where a plurality of nozzles and drop-forming transducers, for example, heaters, are situated. When printhead 30 is fabricated from silicon, the drop-forming transducer control circuits 26 can be integrated with the printhead 30. The printhead 30 also includes a deflection mechanism 70 which is described in more detail below with reference to FIGS. 2 and 3.

Figure 2:
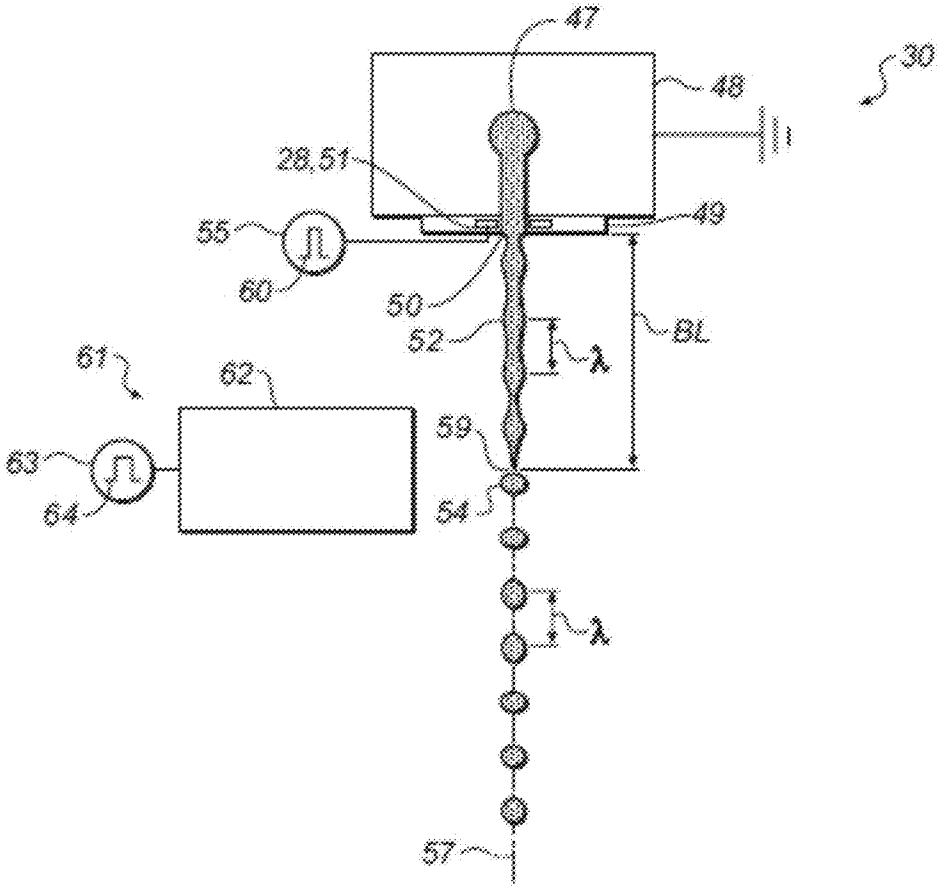
FIG. 2 (Prior Art)
FIG. 2 illustrates a liquid jet being ejected from a drop generator and its subsequent break off into drops with a regular period.

Referring to FIG. 2, a schematic view of continuous liquid printhead 30 is shown. A jetting module 48 of printhead 30 includes an array of nozzles 50 formed in a nozzle plate 49. In FIG. 2, nozzle plate 49 is affixed to the jetting module 48. Alternatively, the nozzle plate 49 can be integrally formed with the jetting module 48. Liquid, for example, ink, is supplied to the nozzles 50 via ink channel 47 at a pressure sufficient to form continuous liquid streams 52 (sometimes referred to as filaments) from each nozzle 50. In FIG. 2, the array of nozzles 50 extends into and out of the figure.

Jetting module 48 is operable to cause liquid drops 54 to break off from the liquid stream 52 in response to image data. To accomplish this, jetting module 48 includes a drop stimulation or drop-forming transducer 28, which, when selectively activated, perturbs the liquid stream 52, to induce portions of each filament to break off and coalesce to form the drops 54. Examples of drop-forming transducer 28 include thermal devices such as heaters for heating the ink, MEMS piezoelectric, electrostrictive or thermal actuators such as are disclosed in commonly-assigned U.S. Pat. No. 8,087,740 (Piatt et al.), electrohydrodynamic devices such as disclosed in U.S. Pat. No. 3,949,410 (Bassous et al.), or optical devices such as those disclosed in U.S. Pat. No. 3,878,519 (Eaton). Depending on the type of transducer used, the transducer can be located in or adjacent to the liquid chamber that supplies the liquid to the nozzles 50 to act on the liquid in the liquid chamber, can be located in or immediately around the nozzles 50 to act on the liquid as it passes through the nozzle, or can be located adjacent to the liquid stream 52 to act on the liquid stream 50 after it has passed through the nozzle 50.

In FIG. 2, the drop-forming transducer 28 is a heater 51, for example, an asymmetric heater or a ring heater (either segmented or not segmented), located in the nozzle plate 49 on one or both sides of the nozzle 50. This type of drop formation is known and has been described in, for example, U.S. Pat. No. 6,457,807 (Hawkins et al.); U.S. Pat. No. 6,491,362 (Jeanmaire); U.S. Pat. No. 6,505,921 (Chwalek et al.); U.S. Pat. No. 6,554,410 (Jeanmaire et al.); U.S. Pat. No. 6,575,566 (Jeanmaire et al.); U.S. Pat. No. 6,588,888 (Jeanmaire et al.); U.S. Pat. No. 6,793,328 (Jeanmaire); U.S. Pat. No. 6,827,429 (Jeanmaire et al.); and U.S. Pat. No. 6,851,796 (Jeanmaire et al.), each of which is incorporated herein by reference.

Typically, one drop-forming transducer 28 is associated with each nozzle 50 of the nozzle array. However, in some configurations, a drop-forming transducer 28 can be associated with groups of nozzles 50 in the nozzle array.

Referring to FIG. 2 the printing system has associated with it, a printhead 30 that is operable to produce, from an array of nozzles 50, an array of liquid streams 52, also called liquid jets. A drop-forming device is associated with each liquid stream 52. The drop-formation device includes a drop-forming transducer 28 and a drop-formation waveform source 55 that supplies a drop-formation waveform sequence 60 to the drop-forming transducer 28. The drop-formation waveform source 55 is a portion of the mechanism control circuits 26. In some embodiments in which the nozzle plate is fabricated of silicon, the drop-formation waveform source 55 is formed at least partially on the nozzle plate 49. The drop-formation waveform source 55 supplies a drop-formation waveform sequence 60, which typically includes a sequence of pulses having a fundamental frequency $f_O$ and a fundamental period of $T_O=1/f_O$ to the drop-formation transducer 28, which produces a modulation in the diameter of the liquid stream; the modulation having a wavelength $\lambda$ along the liquid stream. The jet-diameter modulation moves with the flowing liquid down the liquid stream and it grows in amplitude, causing the larger diameter portions of the liquid stream to further increase in diameter and the smaller diameter portions of the liquid stream to decrease further in diameter. The modulation amplitude grows until, at a distance BL from the nozzle plate 49, the small diameter portions of the liquid stream shrink to a diameter of zero, causing the end portion of the liquid stream 52 to break off into drops 54. Through the action of the drop-formation device, a sequence of drops 54 is produced. In accordance with the drop-formation waveform sequence 60, the drops 54 are formed at the fundamental frequency $f_O$ with a fundamental period of $T_O=1/f_O$. In FIG. 2, liquid stream 52 breaks off into drops with a regular period at breakoff location 59, which is a distance, called the break off length, BL from the nozzle 50. The distance between a pair of successive drops 54 is essentially equal to the wavelength $\lambda$ of the perturbation on the liquid stream 52.

The stream of drops 54 formed from the liquid stream 52 follow an initial trajectory 57.

The time from when a drop-formation waveform pulse is applied to the drop-formation transducer until the jet-diameter modulation produced by the waveform pulse causes a portion of the liquid stream to break off as a drop is called the break-off time BOT. The break-off time BOT of the droplet for a particular printhead can be altered by changing at least one of the amplitude, duty cycle, or number of the stimulation pulses to the respective resistive elements surrounding a respective resistive nozzle orifice, all of which alter the initial modulation amplitude on the liquid stream. In this way, small variations of either pulse duty cycle or amplitude allow the droplet break-off times to be modulated in a predictable fashion within ±one-tenth the droplet generation period.

Also, shown in FIG. 2, is a charging device 61 comprising charging electrode 62 and charging-electrode waveform source 63. The charging electrode 62 associated with the liquid jet is positioned adjacent to the break off point 59 of the liquid stream 52. If a voltage is applied to the charging electrode 62, electric fields are produced between the charging electrode and the electrically grounded liquid jet, and the capacitive coupling between the two produces a net charge on the end of the electrically conductive liquid stream 52. (The liquid stream 52 is grounded by means of contact with the liquid chamber of the grounded drop generator.) If the end portion of the liquid jet breaks off to form a drop while there is a net charge on the end of the liquid stream 52, the charge of that end portion of the liquid stream 52 is trapped on the newly formed drop 54.

Figure 4:
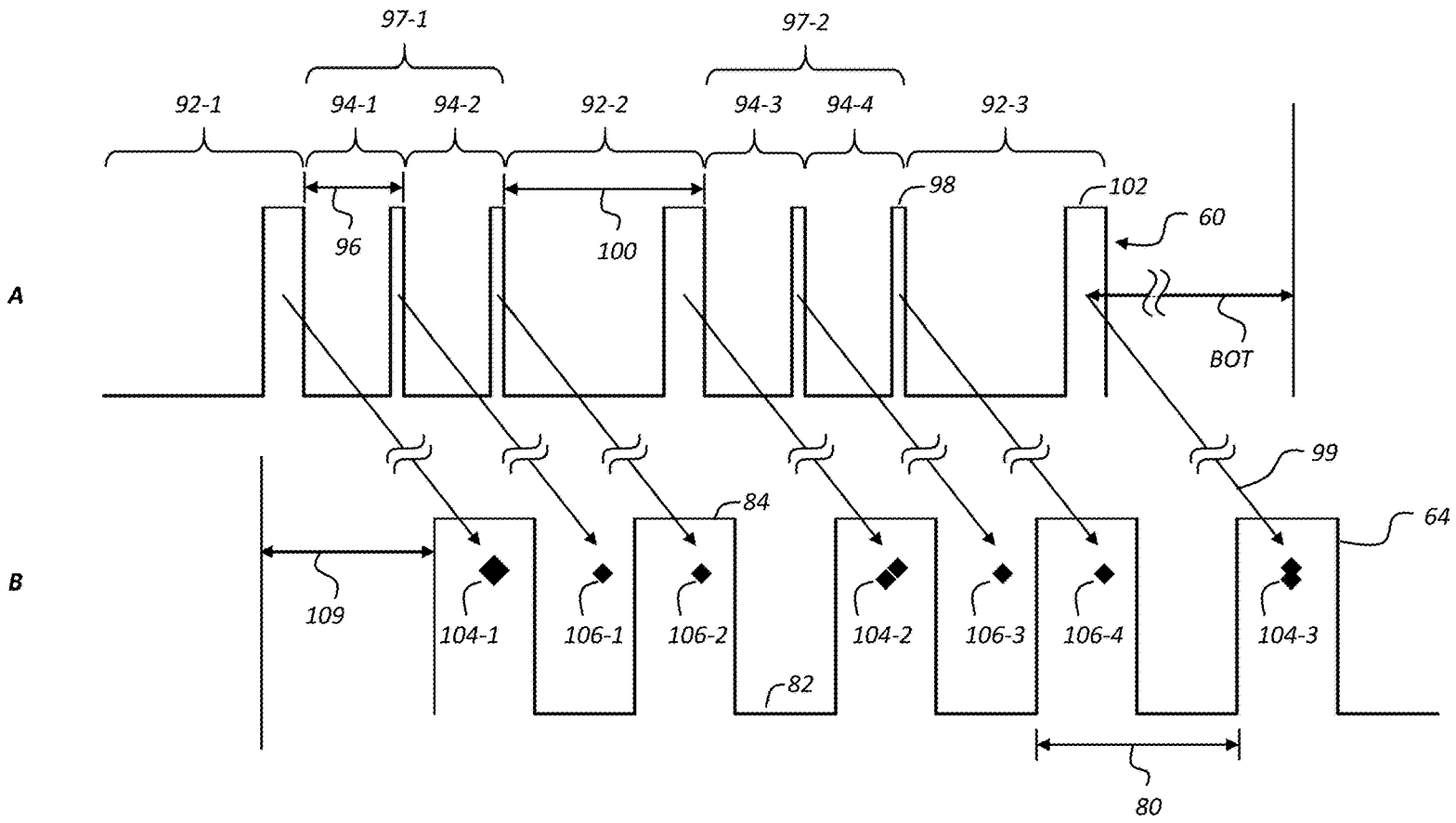
FIG. 4 (Prior Art)
FIG. 4 shows an exemplary timing diagram illustrating drop-formation pulses and a charging-electrode waveform.

The voltage on the charging electrode 62 is controlled by the charging-electrode waveform source 63, which provides a charging-electrode waveform 64 operating at a charging-electrode waveform 64 period 80 (shown in FIG. 4). The charging-electrode waveform source 63 provides a varying electrical potential between the charging electrode 62 and the liquid stream 52. The charging-electrode waveform source 63 generates a charging-electrode waveform 64, which includes a first voltage state and a second voltage state; the first voltage state being distinct from the second voltage state. An example of a charging-electrode waveform is shown in part B of FIG. 4. The two voltages are selected such that the drops 54 breaking off during the first voltage state acquire a first charge state and the drops 54 breaking off during the second voltage state acquire a second charge state. The charging-electrode waveform 64 supplied to the charging electrode 62 is independent of, or not responsive to, the image data to be printed. The charging device 61 is synchronized with the drop-formation device using a conventional synchronization device 27, which is a portion of the control circuits 26, (see FIG. 1) so that a fixed phase relationship is maintained between the charging-electrode waveform 64 produced by the charging-electrode waveform source 63 and the clock of the drop-formation waveform source 55. As a result, the phase of the break off of drops 54 from the liquid stream 52, produced by the drop-formation waveforms 92-1, 92-2, 92-3, 94-1, 94-2, 94-3, 94-4 (see FIG. 4), is phase locked to the charging-electrode waveform 64. As indicated in FIG. 4, there can be a phase shift 109 (or equivalently a time shift) between the charging-electrode waveform 64 and the drop-formation waveforms 92-1, 92-2, 92-3, 94-1, 94-2, 94-3, 94-4.

Figure 3:
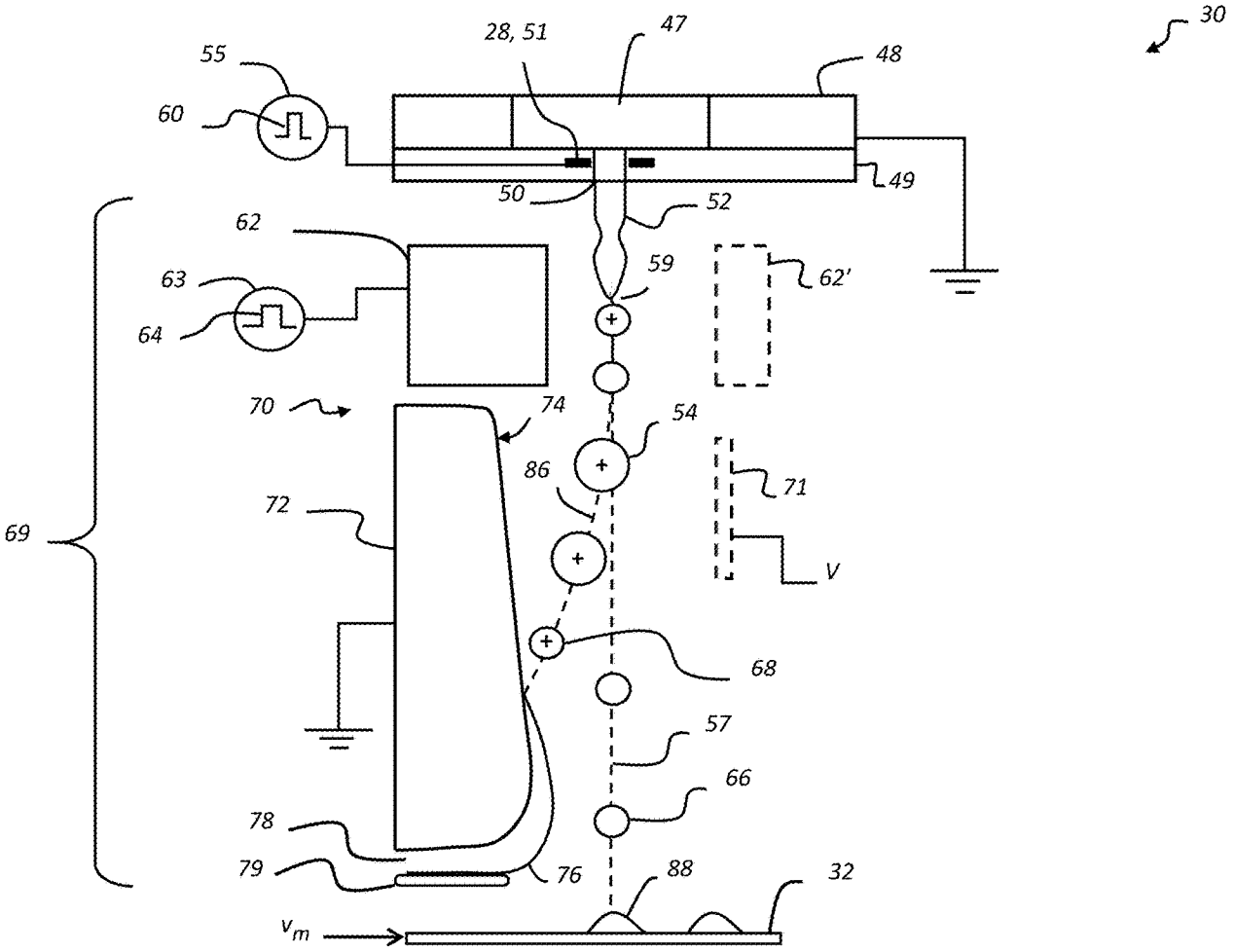
FIG. 3 (Prior Art)
FIG. 3 shows a cross-sectional view of an exemplary inkjet printhead of a continuous liquid ejection system in accordance with the present invention.

With reference now to FIG. 3, printhead 30 includes a drop-forming transducer 28 which creates a liquid stream 52 that breaks up into ink drops 54. Selection of drops 54 as printing drops 66 or non-printing drops 68 will depend upon the phase of the droplet break off relative to the charging electrode voltage pulses that are applied to the to the charging electrode 62 that is part of the deflection mechanism 70, as will be described below. The charging electrode 62 is variably biased by a charging-electrode waveform source 63. The charging-electrode waveform source 63 provides a charging-electrode waveform 64, in the form of a sequence of charging pulses. The charging-electrode waveform 64 is periodic, having a charging-electrode waveform period 80 (FIG. 4).

An embodiment of a charging-electrode waveform 64 is shown in part B of FIG. 4. The charging-electrode waveform 64 comprises a first voltage state 82 and a second voltage state 84. Drops breaking off during the first voltage state 82 are charged to a first charge state and drops breaking off during the second voltage state 84 are charged to a second charge state. The second voltage state 84 is typically at a high level, biased sufficiently to charge the drops 54 as they break off. The first voltage state 82 is typically at a low level relative to the printhead 30 such that the first charge state is relatively uncharged when compared to the second charge state. An exemplary range of values of the electrical potential difference between the first voltage state 82 and a second voltage state 84 is 50 to 300 volts and more preferably 90 to 150 volts.

Returning to a discussion of FIG. 3, when a relatively high-level voltage or electrical potential is applied to the charging electrode 62 and a drop 54 breaks off from the liquid stream 52 in front of the charging electrode 62, the drop 54 acquires a charge and is deflected by deflection mechanism 70 towards the ink catcher 72 as non-printing drop 68. The non-printing drops 68 that strike the catcher face 74 form an ink film 76 on the face of the ink catcher 72. The ink film 76 flows down the catcher face 74 and enters liquid channel 78 (also called an ink channel), through which it flows to the ink recycling unit 44. The liquid channel 78 is typically formed between the body of the ink catcher 72 and a lower plate 79.

Deflection occurs when drops 54 break off from the liquid stream 52 while the potential of the charging electrode 62 is provided with an appropriate voltage. The drops 54 will then acquire an induced electrical charge that remains upon the droplet surface. The charge on an individual drop 54 has a polarity opposite that of the charging electrode 62 and a magnitude that is dependent upon the magnitude of the voltage and the coupling capacitance between the charging electrode 62 and the drop 54 at the instant the drop 54 separates from the liquid jet. This coupling capacitance is dependent in part on the spacing between the charging electrode 62 and the drop 54 as it is breaking off. It can also be dependent on the vertical position of the breakoff point 59 relative to the center of the charge electrode 62. After the charged drops 54 have broken away from the liquid stream 52, they continue to pass through the electric fields produced by the charge plate. These electric fields provide a force on the charged drops deflecting them toward the charging electrode 62. The charging electrode 62, even though it cycled between the first and the second voltage states, thus acts as a deflection electrode to help deflect charged drops away from the initial trajectory 57 and toward the ink catcher 72. After passing the charging electrode 62, the drops 54 will travel in close proximity to the catcher face 74 which is typically constructed of a conductor or dielectric. The charges on the surface of the non-printing drops 68 will induce either a surface charge density charge (for a catcher face 74 constructed of a conductor) or a polarization density charge (for a catcher face 74 constructed of a dielectric). The induced charges on the catcher face 74 produce an attractive force on the charged non-printing drops 68. The attractive force on the non-printing drops 68 is identical to that which would be produced by a fictitious charge (opposite in polarity and equal in magnitude) located inside the ink catcher 72 at a distance from the surface equal to the distance between the ink catcher 72 and the non-printing drops 68. The fictitious charge is called an image charge. The attractive force exerted on the charged non-printing drops 68 by the catcher face 74 causes the charged non-printing drops 68 to deflect away from their initial trajectory 57 and accelerate along a non-print trajectory 86 toward the catcher face 74 at a rate proportional to the square of the droplet charge and inversely proportional to the droplet mass. In this embodiment, the ink catcher 72, due to the induced charge distribution, comprises a portion of the deflection mechanism 70. In other embodiments, the deflection mechanism 70 can include one or more additional electrodes to generate an electric field through which the charged droplets pass so as to deflect the charged droplets. For example, an optional single biased deflection electrode 71 in front of the upper grounded portion of the catcher can be used. In some embodiments, the charging electrode 62 can include a second portion on the second side of the jet array, denoted by the dashed line charging electrode 62', which is supplied with the same charging-electrode waveform 64 as the first portion of the charging electrode 62.

In the alternative, when the drop-formation waveform sequence 60 supplied to the drop-forming transducer 28 causes a drop 54 to break off from the liquid stream 52 when the electrical potential of the charging electrode 62 is at the first voltage state 82 (FIG. 4) (i.e., at a relatively low potential or at a zero potential), the drop 54 does not acquire a charge. Such uncharged drops are unaffected during their flight by electric fields that deflect the charged drops. The uncharged drops therefore become printing drops 66, which travel in a generally undeflected path along the trajectory 57 and impact the print medium 32 to form print dots 88 on the print medium 32, as the recoding medium is moved past the printhead 30 at a speed $V_m$. The charging electrode 62, deflection electrode 71 and ink catcher 72 serve as a drop selection system 69 for the printhead 30.

FIG. 4 illustrates how selected drops can be printed by the control of the drop-formation waveforms 60 supplied to the drop-forming transducer 28. Section A of FIG. 4 shows a drop-formation waveform sequence 60 that includes three large-drop drop-formation waveforms 92-1, 92-2, 92-3, and four small-drop drop-formation waveforms 94-1, 94-2, 94-3, 94-4. The small-drop drop-formation waveforms 94-1, 94-2, 94-3, 94-4 each have a period 96 and include a pulse 98, and each of the large-drop drop-formation waveforms 92-1, 92-2, 92-3 have a longer period 100 and include a longer pulse 102. In this example, the period 96 of the small-drop drop-formation waveforms 94-1, 94-2, 94-3, 94-4 is the fundamental period $T_O$, and the period 100 of the large-drop drop-formation waveforms 92-1, 92-2, 92-3 is twice the fundamental period, $2T_O$. The small-drop drop-formation waveforms 94-1, 94-2, 94-3, 94-4 each cause individual drops to break off from the liquid stream. The large-drop drop-formation waveforms 92-1, 92-2, 92-3, due to their longer period, each cause a larger drop 54 to be formed from the liquid stream 52. The larger drops 54 formed by the large-drop drop-formation waveforms 92-1, 92-2, 92-3 each have a volume that is approximately equal to twice the volume of the drops 54 formed by the small-drop drop-formation waveforms 94-1, 94-2, 94-3, 94-4.

As previously mentioned, the charge induced on a drop 54 depends on the voltage state of the charging electrode at the instant of drop breakoff. The B section of FIG. 4 shows the charging-electrode waveform 64 and the times, denoted by the diamonds, at which the drops 54 break off from the liquid stream 52. The large-drop drop-formation waveforms 92-1, 92-2, 92-3 cause large drops 104-1, 104-2, 104-3 to break off from the liquid stream 52 while the charging-electrode waveform 64 is in the second voltage state 84. Due to the high voltage applied to the charging electrode 62 in the second voltage state 84, the large drops 104-1, 104-2, 104-3 are charged to a level that causes them to be deflected as non-printing drops 68 such that they strike the catcher face 74 of the ink catcher 72 in FIG. 3. The small-drop drop-formation waveforms 94-1, 94-2, 94-3, 94-4 cause small drops 106-1, 106-2, 106-3, 106-4 to form. Arrows 99 denote the link between the waveforms and the drops that they cause to form. As previously mentioned, there is a break-off time interval BOT between the application of a waveform to the drop-formation transducer and the break off of the resulting drop 54. The breaks in the arrows 99 and the BOT arrow are present to indicate that the break-off time BOT is typically many times longer than the drop-formation waveform period 100. Small drops 106-1 and 106-3 break off during the first voltage state 82, and therefore will be relatively uncharged. Therefore, they are not deflected into the ink catcher 72, but rather pass by the ink catcher 72 as printing drops 66 and strike the print medium 32 (see FIG. 3). Small drops 106-2 and 106-4 break off during the second voltage state 84 and are deflected to strike the catcher face 74 as non-printing drops 68. The drop-formation waveform sequence 60 is determined by the print data, while the charging-electrode waveform 64 is not controlled by the pixel data to be printed. This type of drop deflection is known and has been described in, for example, U.S. Pat. No. 8,585,189 (Marcus et al.); U.S. Pat. No. 8,651,632 (Marcus); U.S. Pat. No. 8,651,633 (Marcus et al.); U.S. Pat. No. 8,696,094 (Marcus et al.); and U.S. Pat. No. 8,888,256 (Marcus et al.), each of which is incorporated herein by reference.

Figure 5:
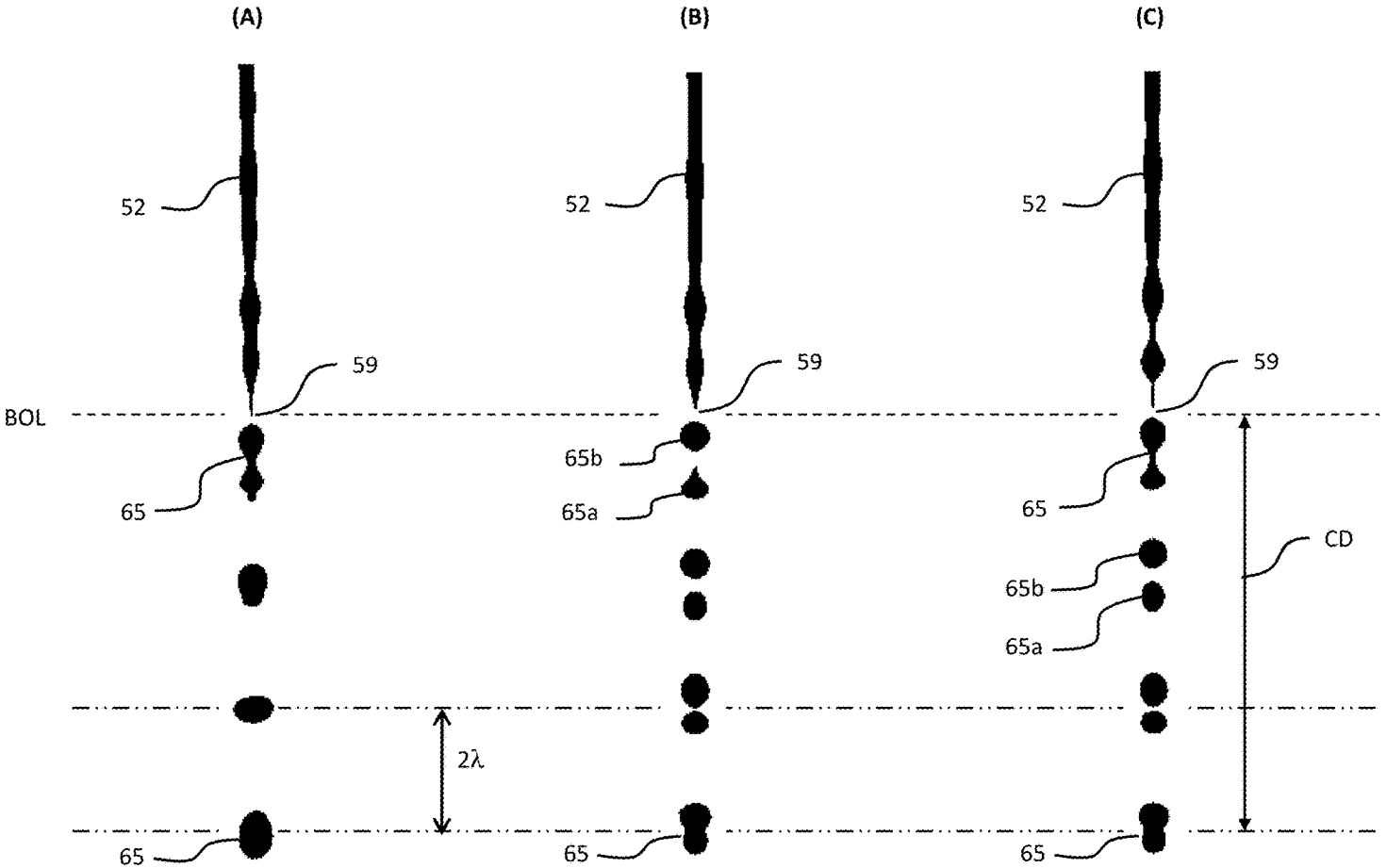
FIG. 5 (Prior Art)
FIG. 5 illustrates a liquid jet being ejected from a drop generator and its subsequent break off into drops.

As illustrated in part (A) of FIG. 5, the large drops 65 created by the large-drop drop-formation waveforms 92-1, 92-2, 92-3 (FIG. 4) may be formed as a single drop that remains a single drop. Under other conditions as illustrated in part (B) of FIG. 5, the large drops 65 can form as two drops 65*a* and 65*b* that break off from the liquid stream 52 at almost the same time that subsequently merge to form the large drop 65. Alternatively, as indicated in part (C) of FIG. 5, the large drop can form as a large drop 65 that breaks off from the liquid stream that breaks apart into two drops 65*a*, 65*b* and then merges back to a single large drop 65. The distance below the breakoff point 59 at which the drops 65*a* and 65*b* coalesce to form the large drop 65 is called the coalescence distance CD. It is generally desirable to keep the coalescence distance CD small. The large drop formation process of part (A) of FIG. 5 is denoted in FIG. 4 by the large diamond for large drop 104-1. The large drop formation process of part (B) of FIG. 5 is denoted in FIG. 4 by two closely spaced diamonds for large drop 104-2, and the large drop formation process of part (C) of FIG. 5 is denoted in FIG. 4 by the double diamond for large drop 104-3.

For each nozzle in the nozzle array, a drop-formation waveform sequence 60 including a sequence of large-drop drop-formation waveforms 92 (e.g., 92-1, 92-2, 92-3 of FIG. 4) and small-drop drop-formation waveforms 94 (e.g., 94-1, 94-2, 94-3, 94-4 of FIG. 4) is created by the by the drop-formation waveform source 55 in response to the image data to be printed. When the image data for a particular nozzle requires a print drop is to be formed, a pair of small-drop drop-formation waveforms 94 is added to the waveform sequence 60 for that nozzle, and conversely when no print drop is to be created, a large-drop drop-formation waveform 92, which can also be referred to as a non-printing drop-formation waveform, is added to the waveform sequence 60 for that nozzle. As the small-drop drop-formation waveforms 94 are always added to the drop-formation waveform sequence 60 in pairs whenever a print drop is required, the pair of small-drop drop-formation waveforms 94 (e.g., 94-1, 94-2) is herein considered to be a printing-drop drop-formation waveform 97 (e.g., 97-1). The printing-drop drop-formation waveform 97 can also be referred to as a drop-pair drop-formation waveform or more simply as a printing drop-formation waveform. The printing-drop drop-formation waveform 97 has the same period 96 as the non-printing drop-formation waveform 92. In FIG. 4, the small-drop drop-formation waveforms 94-1, 94-2 together form the printing-drop drop-formation waveform 97-1, and the small-drop drop-formation waveforms 94-3, 94-4 together form the printing-drop drop-formation waveform 97-2.

While the example of FIG. 4 shows each of the non-printing large-drop drop-formation-waveforms 92-1, 92-2, 92-3 as being identical with each other and each of the printing-drop drop-formation waveforms 97-1, 97-2 as being identical with each other, this is not a requirement. In some embodiments, there may be multiple variations of non-printing large-drop drop-formation waveforms 92 and multiple variations of printing-drop drop-formation waveforms 97. In this case, selection of a particular one of the waveforms may depend not only on the printing/non-printing status of a corresponding pixel but also on printing/non-printing status for one or both of preceding and trailing drops as well, as is disclosed in U.S. Pat. No. 8,469,495 (Gerstenberger et al.).

Figure 6:
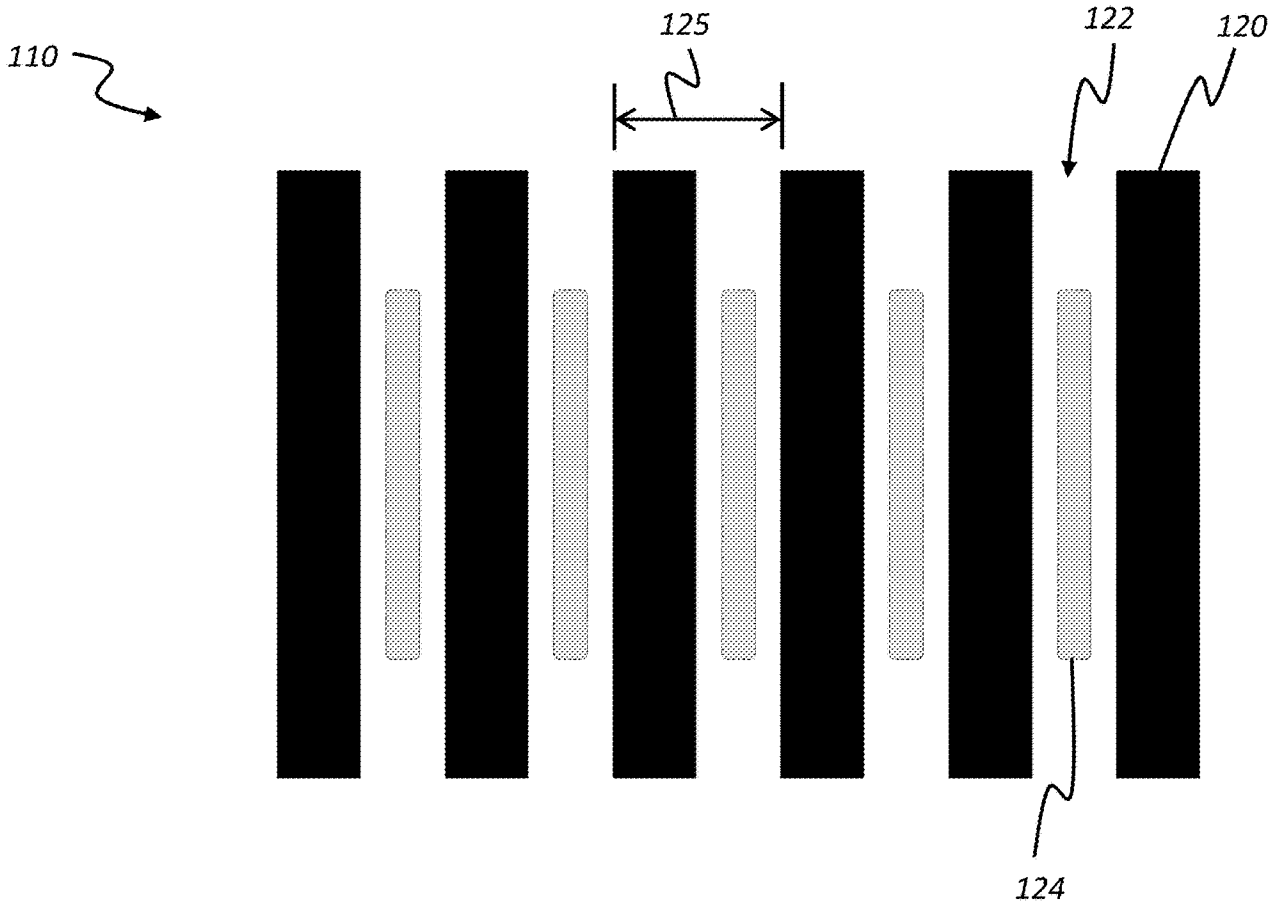
FIG. 6 is a representation of a portion of the print media including a spatially periodic printed pattern and induced print defects.

Referring to FIG. 6, although the above-described printing system has been found to generally work well, certain print situations have been found to produce print defects, commonly referred to as print artifacts. When images including certain periodic patterns 110 of spaced-apart, broad character strokes 120 are printed, diffuse regions 124 of scattered ink spots have been found in the spaces 122 between the character strokes 120. The presence of these diffuse regions 124 of undesirable ink spots depends on the spatial period 125 of the pattern of the character strokes 120 and on the print speed; the print defect is more pronounced at high print speeds. Without being bound by the understanding of the physics involved, this form of print defect seems to be an outcome of a resonance excited by the spatially periodic application of drop-formation waveforms, which are required to print the periodic pattern 110.

Figure 7:
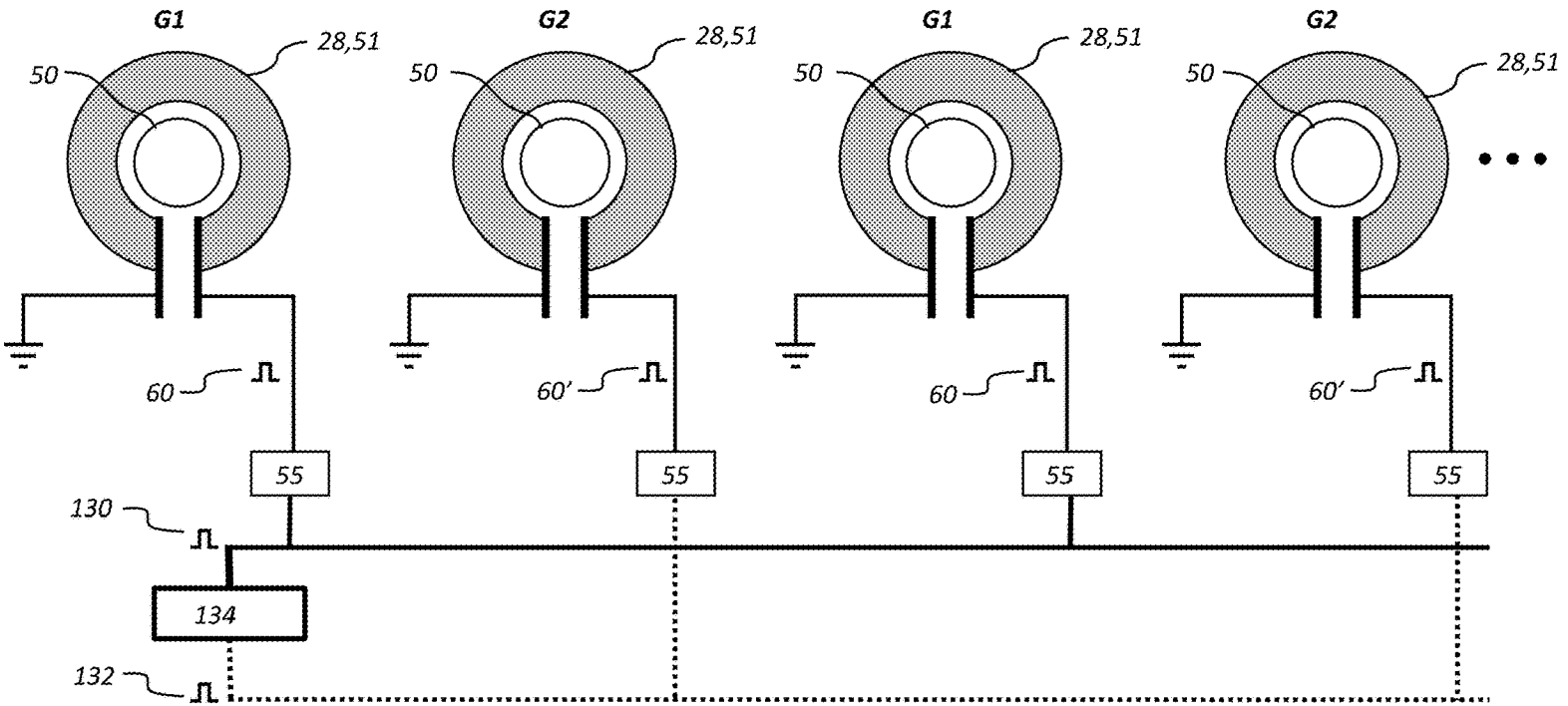
FIG. 7 is a simplified block schematic diagram of four adjacent nozzles arranged into two groups and associated drop formation devices according to an exemplary embodiment.

It has been discovered that the formation of these diffuse regions 124 of scattered ink spots can be suppressed by segmenting the array of nozzles 50 into first and second groups of interleaved nozzles 50, and introducing a phase shift and a drop-formation waveform energy difference between the drop-formation waveforms supplied to the drop-formation devices associated with these two groups of nozzles 50. In order to accomplish this, the plurality of nozzles 50 are arranged or grouped into a first group G1 and a second group G2 in which the nozzles 50 of the first group G1 and the second group G2 are interleaved such that nozzles 50 of the first group G1 are positioned between adjacent nozzles 50 in the second group G2 and nozzles 50 of the second group G2 are positioned between adjacent nozzles 50 in the first group G1, as shown in FIG. 7.

Each of the nozzles 50 in the first group G1 has an associated drop-formation device (which includes a drop-forming transducer 28 such as a heater 51), which for brevity will be referred to as a first-group drop-formation device. Each of the nozzles 50 in the second group G2 has an associated drop-formation device, which for brevity will be referred to as a second-group drop-formation device.

A timing delay device 134 supplies a first group trigger pulse 130 to control the starting time of the drop-formation waveforms 60 provided to the first-group drop-formation devices and a second group trigger pulse 132 to control the starting time of the drop-formation waveforms 60' supplied to the second-group drop-formation devices. In a preferred embodiment, the timing delay device 134 shifts the timing of the drop-formation waveforms 60, 60' supplied to one or both of the first-group drop-formation devices and the second-group drop-formation devices so that the waveform pulses in the drop-formation waveforms 60 supplied to the first-group drop-formation devices precedes the waveform pulses in corresponding drop-formation waveforms 60' supplied to the second-group drop-formation devices by a defined second-group time shift 108. (The second group time shift 108 can equivalently be referred to as a "second group phase shift" since it shifts the phase of the drop formation waveforms 60' relative to the phase of the drop formation waveforms 60).

In addition, the waveform energy of the drop-formation waveforms 60' supplied to the second-group drop-formation devices are increased relative to the waveform energy of the drop-formation waveforms 60 supplied to the first-group drop-formation devices. In this way, the break-off times BOT' of the drops from the second-group nozzles 50 are controlled so that they are less than the break-off times BOT of the drops from the first-group nozzles 50.

The waveform energies and the timing delay are selected such that the printing small drops 106-1, 106-3, 106-1', 106-3' break off from the liquid jets during the first voltage state 82 of the charging-electrode waveform 64 to provide the first printing-drop charge state, and the non-printing small drops 106-2, 106-4, 106-2', 106-4' and the non-printing large drops 104-1, 104-2, 104-3, 104-1', 104-2', 104-3' break off from the liquid jets during the second voltage state 84 of the charging-electrode waveform 64 to provide the second non-printing-drop charge state.

Figure 8:
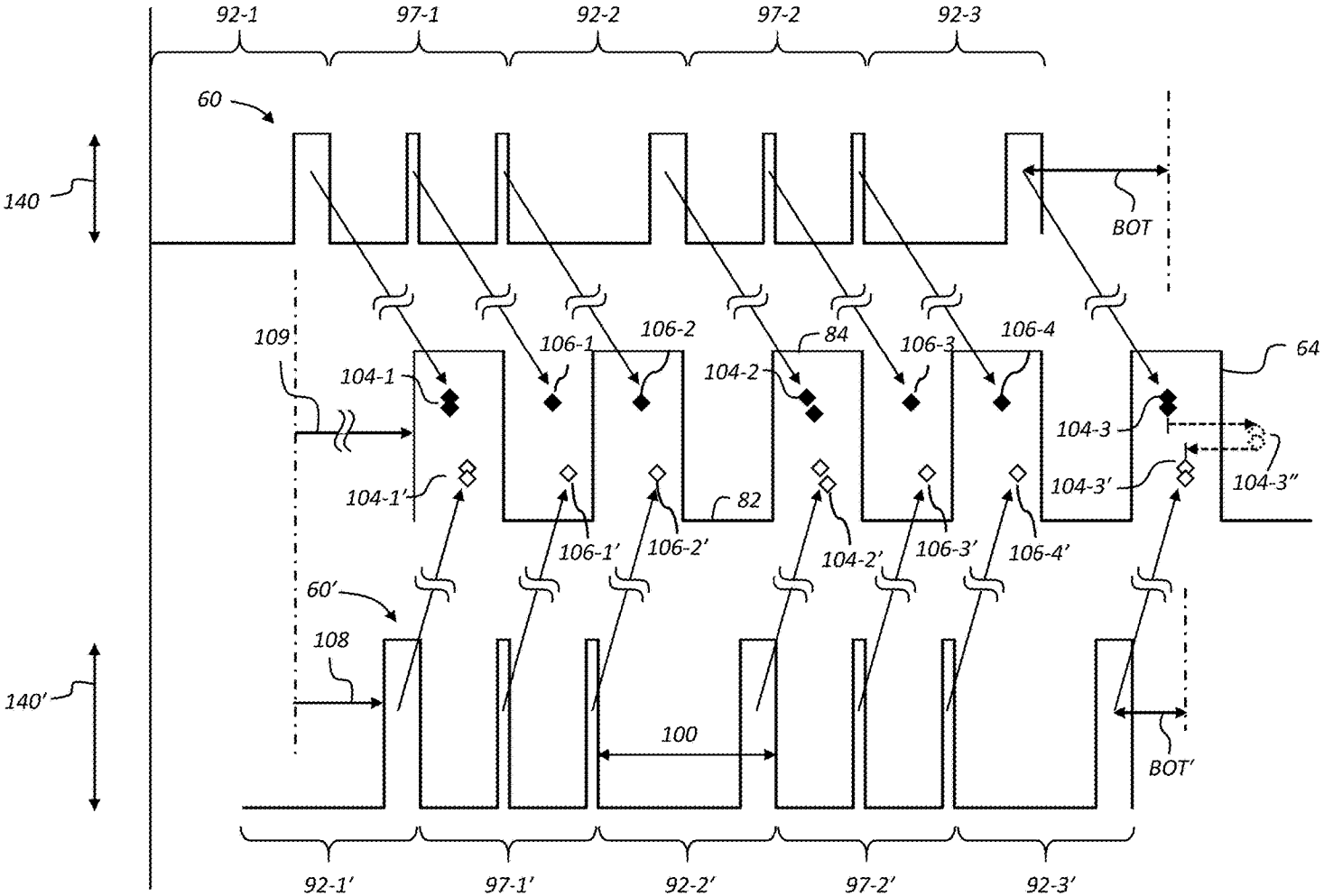
FIG. 8 shows a timing diagram illustrating drop formation pulses applied to two groups of drop formation transducers, where the drop formation pulses applied to the second group are time delayed and have a higher amplitude than the drop formation pulses applied to the first group.

An embodiment of this is illustrated in FIG. 8. The upper portion of FIG. 8 shows a portion of a drop-formation waveform sequence 60 which is supplied to a first-group drop-formation device. The drop-formation waveform sequence 60 is formed in response to the image data for a first-group nozzle 50. In this example, the drop-formation waveform sequence 60 includes large-drop drop-formation waveforms 92-1, 92-2, 92-3 and printing-drop drop-formation waveforms 97-1, 97-2. The lower portion of FIG. 8 shows a portion of a drop-formation waveform sequence 60' which is supplied to a second-group drop-formation device. The drop-formation waveform sequence 60' is formed in response to the image data for a second-group nozzle 50. In this example, the drop-formation waveform sequence 60' includes large-drop drop-formation waveforms 92-1', 92-2', 92-3' and printing-drop drop-formation waveforms 97-1', 97-2'.

For brevity, the first drop-formation waveform sequence 60 can be referred to as first-set waveforms, and the second drop-formation waveform sequence 60' can be referred to as second-set waveforms. The first-set and the second-set waveforms each include one or more printing-drop-formation waveforms 97 (e.g., 97-1, 97-2, 97-1', 97-2'), which, when supplied to a drop-formation device associated with a particular nozzle, modulate the liquid jet ejected from the particular nozzle to selectively cause portions of the liquid jet to break off into a pair of drops traveling along a path. The first-set and the second-set waveforms also each include non-printing large-drop drop-formation waveforms 92 (e.g., 92-1, 92-2, 92-3, 92-1', 92-2', 92-3'), which, when supplied to a drop-formation device associated with a particular nozzle, modulate the liquid jet ejected from the particular nozzle to selectively cause a portion of the liquid jet to break off into a large non-printing drop traveling along the path. Each of these printing and non-printing drop-formation waveforms have the same waveform period.

The central portion of FIG. 8 shows a portion of the charging electrode waveform 64, along with the times at which the drops 54 (FIG. 3) break off from the liquid stream 52 (FIG. 3) in response to the illustrated portions of the drop-formation waveforms 60 and 60'. The times at which the drops 54 break off from the liquid streams 52 from the first-group nozzles are denoted by filled diamonds, and the times at which the drops 54 break off from the liquid streams 52 from the second-group nozzles are denoted by open diamonds. For clarity, the first drop-formation waveform sequence 60 and the second drop-formation waveform sequence 60' are shown with the same pattern of printing and non-printing drops. However, in practice, the first and second sequences can differ in response to their corresponding image data. It can be seen that the second drop-formation waveform sequence 60' has been delayed by a second-group time shift 108 relative to the first drop-formation waveform sequence 60.

The first-set and second-set waveforms from which the first drop-formation waveform sequence 60 and the second drop-formation waveform sequence 60' are formed differ in their amplitude. The amplitude 140' of the second-set waveforms is larger than the amplitude 140 of the first-set waveforms. As each of the drop-formation waveforms has an associated waveform energy that it supplies to its corresponding drop-formation device, the larger waveform amplitudes 140' of the second-set waveforms supply the second-group drop-formation transducers 28 (FIG. 3) with larger waveform energies than is supplied to the first-group drop-formation transducers 28 by the corresponding drop-formation waveforms from the first-set waveforms.

More particularly the energy levels of the Fourier components of the printing-drop drop-formation waveforms 97 (e.g., 97-1', 97-2') used to from the small printing drops and the energy levels of the Fourier components of the large-drop drop-formation waveforms 92 (e.g., 92-1', 92-2', 92-3') used to form the large non-printing drops are larger for the second-set waveforms than for the corresponding drop-formation waveforms in the first-set waveforms. For brevity, the term waveform energy of a printing-drop drop-formation waveform 97 (e.g., 97-1') shall refer to the energy level of the Fourier components of the drop-formation waveform at the frequency appropriate for the modulating the liquid stream to form a pair of small drops 106 (e.g., 106-1', 106-2'), and the waveform energy of a non-printing large-drop drop-formation waveform 92 (e.g., 92-1') shall refer to the energy level of the Fourier components of the drop-formation waveform at the frequency appropriate for the modulating the liquid stream to form a non-printing larger drop 104 (e.g., 104-1').

As a result of the larger waveform energies associated with of the second-set waveforms, the second-group drop-formation devices modulate the diameters of the liquid streams emitted from the second group nozzles at higher initial modulation amplitudes than the initial modulation amplitudes created on liquid streams 52 emitted from the first group nozzles 50 by the first-group drop-formation devices. As higher initial modulation amplitudes created on the liquid streams 52 from second group nozzles 50 reduce the time required for the modulation amplitude to grow sufficiently to cause drops 54 to break off from the liquid streams 52, the break-off times BOT' for drops from the second group G2 of nozzles 50 will be less than the break-off times BOT for drops from the first group G1 of nozzles 50.

Consider now the times at which large drops 104-3, 104-3' break off from the liquid streams 52 from the first group and second group nozzles 50, respectively. If the same waveform energies were supplied to both groups of drop-formation devices, the second-group time shift 108 between the first and second drop-formation waveform sequences 60, 60' would cause the time of break off for the drops from the second group of nozzles to be delayed by the same time delay as the first group as indicated by the position of the large drop 104-3". However, if large drop 104-3" from the second group nozzle were to break off at this time, then it would break off during the first voltage state 82 instead of breaking off as it should have during the second voltage state 84 like the large drop 104-3 from the first nozzle group. This would cause the large drop 104-3" to have a first charge state instead of the desired second charge state and would cause the large drop 104-3" to be printed instead of being deflected to the catcher as intended. But the difference in the break-off times BOT and BOT' produced by the waveform energy difference between the first-set and second-set waveforms advances the time of break off for the large drop back to the position of the large drop 104-3'. Consequently, the large drop 104-3' breaks off during the second voltage state 84, causing the large drop 104-3' to be charged to the second charge state as intended.

The increased waveform energies associated with the second-set large-drop drop-formation waveform 92-3' relative to the waveform energy associated with first-set large-drop drop-formation waveform 92-3 at least partially compensates for the second-group time shift 108. In a similar manner, the increased waveform energies associated with the each of the second-set printing and non-printing drop-formation waveforms 97', 92', relative to the waveform energies associated with the corresponding first-set printing and non-printing drop-formation waveforms 97, 92, at least partially compensate for the second-group time shift 108 between the waveforms. This enables each of the drops from the nozzles 50 in the second group G2 to break off during the intended voltage state of the charging electrode waveform 64, while still having a time shift between the first set and the second-set waveforms that suppresses the formation of diffuse regions 124 of scattered ink spots discussed relative to FIG. 5. For acceptable suppression of the diffuse regions 124 of scattered ink spots, it has been found that the drop-formation waveform sequence 60' supplied to the drop-formation devices associated with the second group G2 of nozzles 50 should be delayed by a second-group time shift 108 in the range of ¼ to ¾ of the waveform period 100 relative to the drop-formation waveform sequence 60 used to control the drop-formation devices associated with the first group G1 of nozzles 50. In a preferred embodiment, the second-group time shift 108 should be approximately ½ of the waveform period 100.

In the exemplary configuration of FIG. 8, the second-set drop-formation waveform sequence 60' was delayed by a second-group time shift 108 relative to the first-set drop-formation waveform sequence 60 and the waveform energies associated with the second-set drop-formation waveform sequence 60' was increased relative to the waveform energies associated with the first-set drop-formation waveform sequence 60 by increasing the voltage amplitude of the second-set drop-formation waveform sequence 60' relative to the voltage amplitude of the first-set drop-formation waveform sequence 60. Within the bounds of the invention, alternate means can be used for supplying second-set drop-formation waveform sequence 60' with higher associated waveform energies than the waveform energies of the first-set drop-formation waveform sequence 60.

Figure 9:
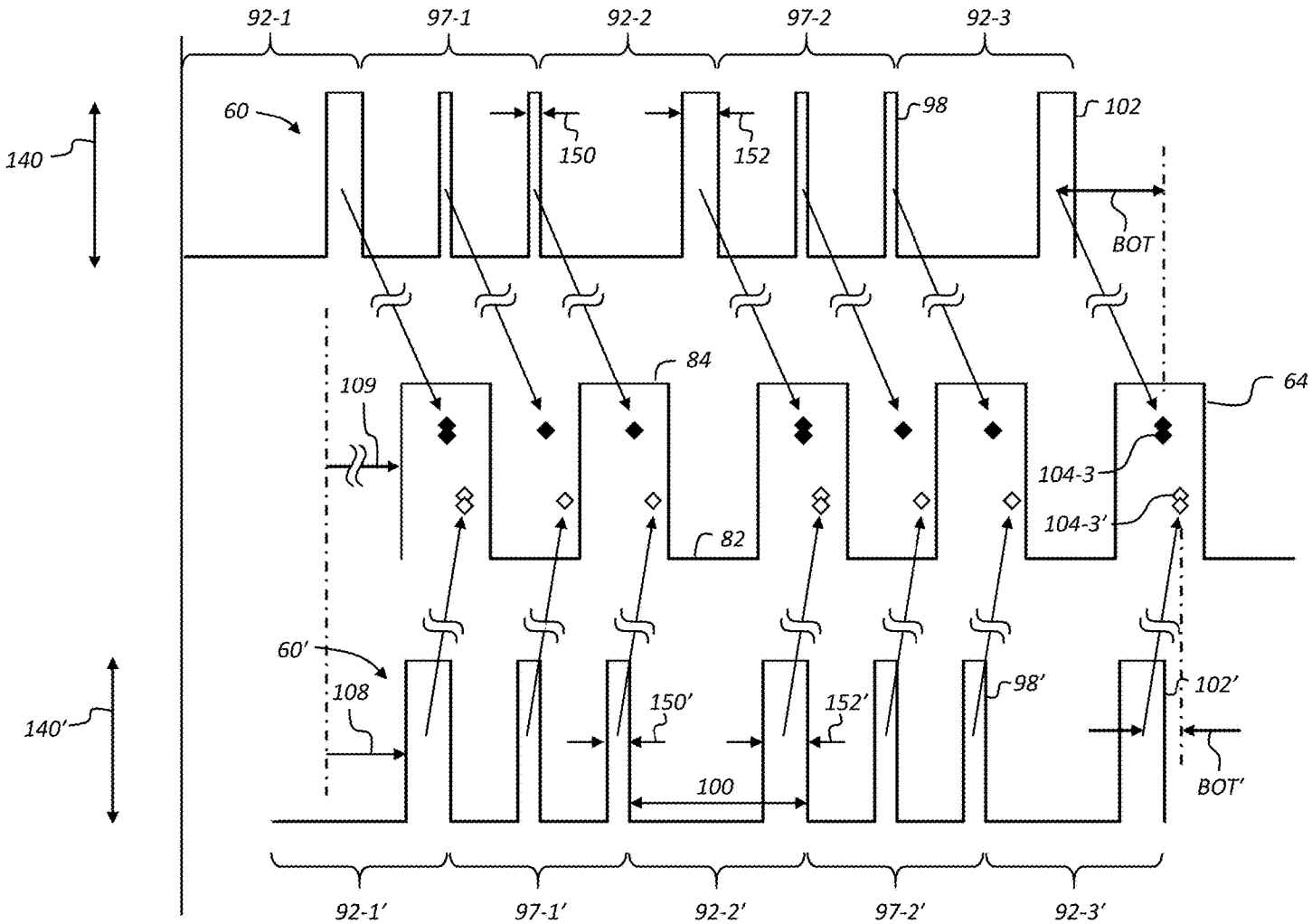
FIG. 9 shows a timing diagram illustrating drop formation pulses applied to two groups of drop formation transducers, where the drop formation pulses applied to the second group are time delayed and have a larger pulse width than the drop formation pulses applied to the first group.

FIG. 9 illustrates an alternate configuration where the waveform energies are adjusted by changing the pulse widths/duty cycles rather than the waveform amplitudes. In this example, the amplitude 140' of the second-set drop-formation waveform sequence 60' is the same as the amplitude 140 of the first-set drop-formation waveform sequence 60, but the drop-formation waveforms differ in the duty cycle or pulse width of the waveform pulses. The drop-formation waveforms in the first set drop-formation waveform sequence 60 and the second-set drop-formation waveform sequence 60' are similar to each other, such that each waveform pulse in the drop-formation waveforms in the second-set drop-formation waveform sequence 60' corresponds to a waveform pulse in the corresponding drop-formation waveforms in the first-set drop-formation waveform sequence 60. That is, for each pulse in a first-set drop-formation waveform there is exactly one pulse in the corresponding second-set drop-formation waveform, and the phase at which the pulses are placed within the drop-formation waveforms are similar (i.e., to within 45°) for the first-set and second-set drop-formation waveforms. The drop-formation pulses also have a similar shape. In this case, the drop-formation pulses have a square-wave shape, although this is not a requirement. In other configurations, the drop-formation pulses can have other shapes such as triangular pulse shapes or trapezoidal pulse shapes.

In the example of FIG. 9, the first-set and the second-set drop-formation waveforms differ in that the drop-formation pulses of each of the second-set drop-formation waveforms have increased duty cycles (or pulse widths) relative to corresponding drop-formation pulses of the first-set drop-formation waveforms. In the upper section of FIG. 9, the printing-drop drop-formation waveforms 97-1, 97-2 for the first-set drop-formation waveform sequence 60 each include two drop-formation pulses 98 with a pulse width 150, and the non-printing drop-formation waveforms 92-1, 92-2, 92-3 each include a drop-formation pulse 102 with a pulse width 152. Similarly, in the lower section of FIG. 9, the printing-drop drop-formation waveforms 97-1', 97-2' for the second-set drop-formation waveform sequence 60' each include two drop-formation pulses 98' with a pulse width 150', and the non-printing drop-formation waveforms 92-1', 92-2', 92-3' each include a drop-formation pulse 102' with a pulse width 152'. In this exemplary configuration, the pulse widths 150' of the second-set printing-drop drop-formation waveform pulses 98' are larger than the pulse widths 150 of the corresponding first-set printing-drop drop-formation waveform pulses 98. Similarly, the pulse widths 152' of the second-set non-printing drop-formation waveform pulses 102' are larger than the pulse widths 150 of the corresponding first-set non-printing drop-formation waveform pulses 102.

In the exemplary configuration of FIG. 9, the rising edges of the pulses within the first-set drop-formation waveforms occur at the same phase from the onset of the waveform as the rising edges of the pulses within the second-set drop-formation waveforms. In other embodiments, it may be the falling edges or the midpoints of the corresponding drop-formation pulses of the first set and second-set waveforms that coincide to within 45° of each other from the onset of the waveforms.

Figure 10:
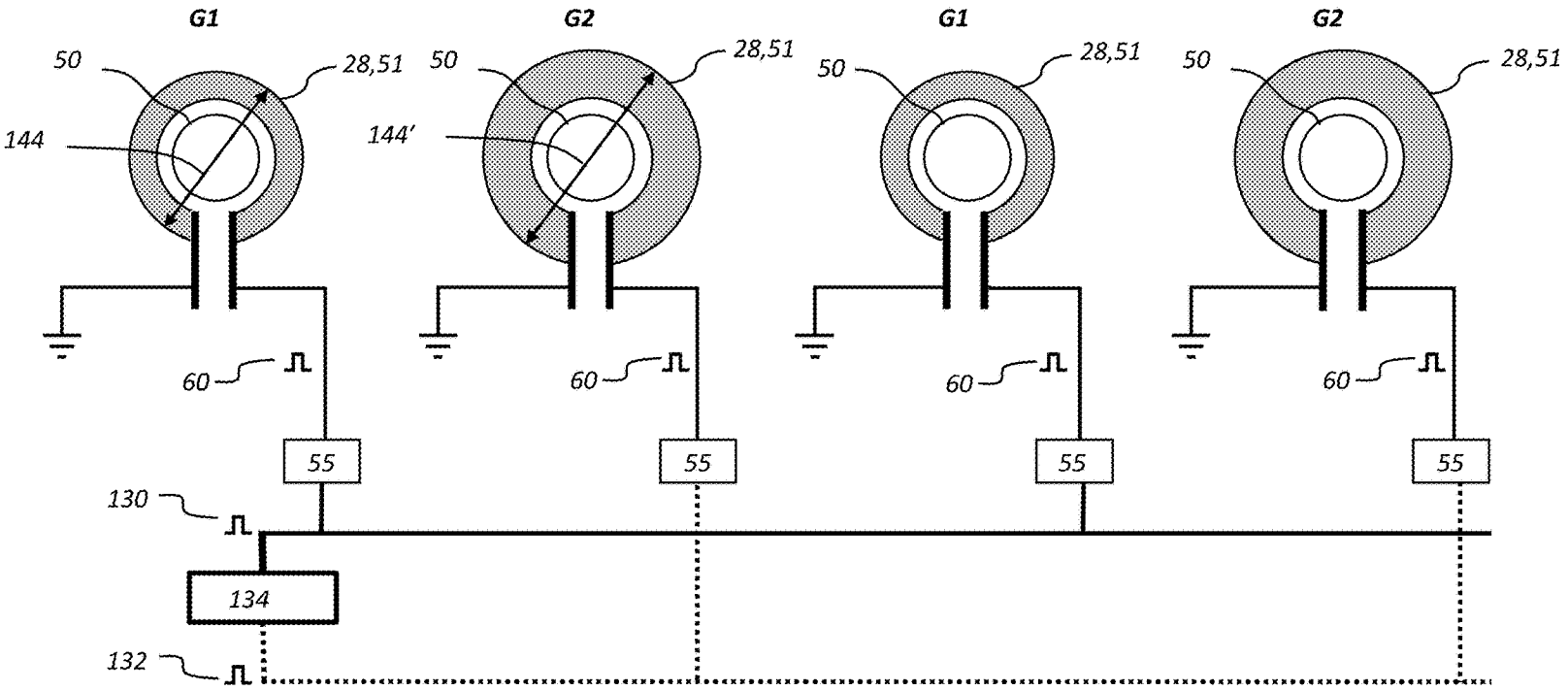
FIG. 10 is a simplified block schematic diagram of four adjacent nozzles arranged into two groups and associated drop formation transducers, where the drop formation transducers associated with the second group have a lower resistance than the drop formation transducers associated with the first group to provide higher waveform energies.

Another exemplary embodiment is illustrated in FIG. 10. In this case, the difference in the waveform energies between the first group G1 and second group G2 of nozzles 50 are provided by a difference in the construction between the first-group drop-formation devices and the second-group drop-formation devices, such that the second-group drop-formation devices produce a greater modulation amplitude of the liquid streams than the first-group drop-formation devices when both the first and the second-group drop-formation devices are supplied with the same drop-formation waveforms.

In the exemplary embodiment of FIG. 10, the drop-formation devices are heaters 51 formed in the nozzle plate 49 (FIG. 3) around each nozzle 50. The geometry of the heaters 51 associated with the two groups of nozzles 50 differ (in this case, the outer diameter 144' of the heaters 51 in the second group G2 is greater than the outer diameter 144 of the heaters 51 in the first group) so that the heaters 51 associated with the second group G2 of nozzles 50 have a lower resistance than the heaters 51 associated with the first group G1 of nozzles 50. As a result, the heaters 51 associated with the second group G2 of nozzles 50 produce more heat than the heaters 51 associated with the second group G2 of nozzles 50 when both are supplied with the same drop-formation waveforms.

In an alternative embodiment, the physical geometries of the two group of heaters 51 can be identical, but the heaters 51 associated with the second group G2 of nozzles 50 can have a lower resistance than the heaters 51 associated with the first group G1 of nozzles 50 due to the use of different heater materials having different resistivities. Alternatively, the coupling factor between the heaters 51 and the ink can be altered to modify the waveform energy imparted to the liquid stream 52, for example by providing different amounts of thermal insulation between the heaters 51 and the nozzles 50.

In a similar manner, differences in the construction of other types of drop-formation transducers 28 (e.g., piezoelectric devices, MEMS actuators, electrohydrodynamic devices, optical devices, or electrostrictive devices) could enable the drop-formation waveforms supplied to the drop-formation transducers 28 associated with the second group G2 of nozzles 50 to supply more associated waveform energy to the drop-formation transducers 28 than the waveform energy supplied to the drop-formation transducers 28 associated with the first group G1 of nozzles 50 by a similar drop-formation waveform, such that the initial modulation amplitude of the liquid streams is larger for the second group G2 of nozzles 50 than for the first group G1.

In the preceding embodiments, each of the drop-formation waveforms included a single drop-formation pulse for each drop that was to be formed by the drop-formation waveform. The printing-drop drop-formation waveform 97 therefore included two drop-formation pulses to create the printing drop and the non-printing drop of the drop pair, and the non-printing large-drop drop-formation waveform 92 had a single drop-formation pulse to create the single non-printing large drop. In the alternate embodiment of FIG. 11, the drop-formation waveforms include not only primary pulses 154 (i.e., the drop-formation pulses primarily responsible for initiating the formation of a drop), but they also include one or more secondary pulses 156 as well. These additional secondary pulses 156, which can also be referred to as secondary drop-formation pulses, typically have smaller duty cycles than the primary pulses 154.

As discussed in commonly-assigned U.S. Pat. No. 7,828,420 to Fagerquist et al., entitled "Continuous ink jet printer with modified actuator activation waveform," which is incorporated herein by reference, if the time separation between a secondary pulse 156 and a primary pulse 154 is less than the Rayleigh cut-off period, such that spacing between perturbations is less than n times the diameter of the liquid stream, then the secondary pulse 156 will not induce the break off of an additional drop from the liquid stream 52. (The secondary pulses 156 are typically separated in time from the primary pulses 154 by greater than the thermal response time of the heater so that they create a heat pulse on the liquid stream that is distinct from the heat pulse of the primary pulse 154.)

As described in U.S. Pat. No. 7,828,420 (Fagerquist et al.), U.S. Pat. No. 8,714,676 (Grace et al.), and U.S. Pat. No. 8,684,483 (Grace et al.), all commonly assigned, the inclusion of one or more secondary pulses in a large-drop drop-formation waveform 92 can aid in stabilizing the formation of the non-printing large drops 65 to correspond to the drop formation condition of part (A) of FIG. 5, or in accelerating the coalescence of the large drop 65 from two or more smaller drops 65*a* and 65*b* to reduce the coalescence distance CD of parts (B) and (C) of FIG. 5. Similarly, the inclusion of one or more secondary pulse in the printing-drop drop-formation waveforms 97 can reduce the formation of undesirable satellite drops or speed up the merging of satellites drops with the printing drop and the non-printing drop of the drop pair. The inclusion of secondary pulses can also be used to alter the velocity of the drops formed by the primary drop-formation pulses as discussed in U.S. Patent Application Publication 2011/0242169 (Link et al.), U.S. Pat. No. 8,469,496 (Panchawagh et al.), and U.S. Pat. No. 8,657,419 (Panchawagh et al.), all commonly assigned.

Figure 11:
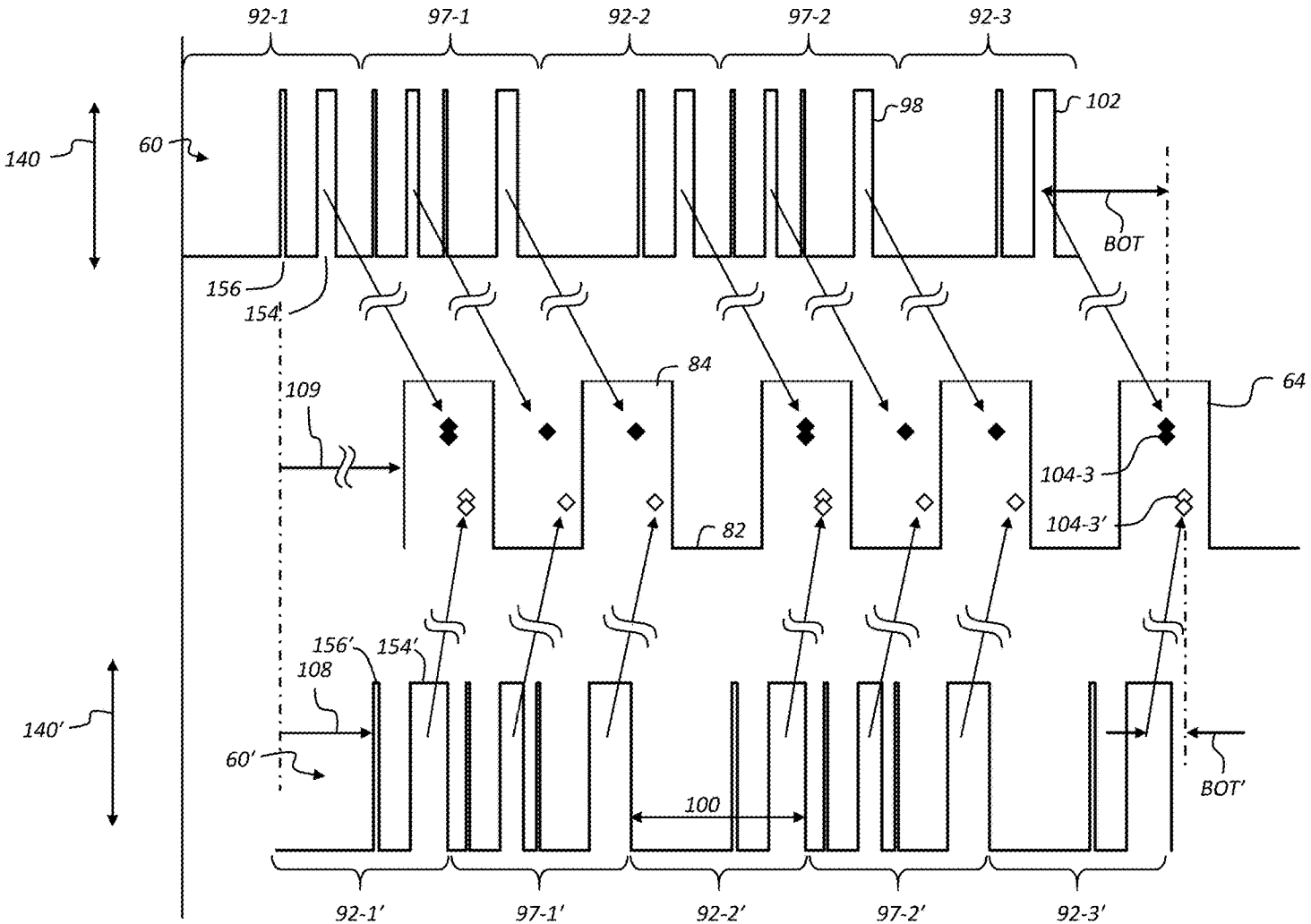
FIG. 11 shows a timing diagram illustrating drop formation pulses applied to two groups of drop formation transducers, where the drop-formation waveforms include secondary pulses in addition to the primary drop-formation pulses.

In the embodiment of FIG. 11, the larger waveform energy associated with the second-set drop-formation waveform sequence 60' when compared to the first-set drop-formation waveform sequence 60 is provided by the primary pulses 154' in the second-set drop-formation waveform sequence 60' having larger pulse widths than the corresponding primary pulses 154 in the first-set drop-formation waveform sequence 60, while the pulse widths of secondary pulses 156' in the second-set drop-formation waveform sequence 60' are equal to the pulse widths of the corresponding secondary pulses 156 in the first-set drop-formation waveform sequence 60. In some embodiments, the second-set drop-formation waveforms can have different numbers of secondary pulses 156 than the corresponding drop-formation waveform from the first-set drop-formation waveforms.

In certain embodiments, the first-set and the second-set waveforms can each include a plurality of printing-drop drop-formation waveform 97 to accommodate different printing drop/non-printing drop sequence options. As was discussed in commonly-assigned U.S. Pat. No. 8,469,495 (Gerstenberger et al.), the selection of an appropriate drop-formation waveform from the set predefined set of drop-formation waveforms can depend not only on the printing/non-printing state of the image data for the current drop-formation waveform, but also on the printing/non-printing state of the image data for the previous drop-formation waveform and/or the following drop-formation waveform. For example, certain printing-drop drop-formation waveforms 97 are used when the preceding drop-formation waveform is a non-printing large-drop drop-formation waveform 92, while other printing-drop drop-formation waveforms 97 are used when the preceding drop-formation waveform is a printing-drop drop-formation waveform 97. Similarly, certain printing-drop drop-formation waveforms 97 are used when the following drop-formation waveform is a non-printing large-drop drop-formation waveform 92, while other printing-drop drop-formation waveforms 97 are used when the following drop-formation waveform is a printing-drop drop-formation waveform 97. The plurality of printing-drop drop-formation waveforms can vary in the duty cycles and onset times of the primary pulses 154 or the secondary pulses 156. The different printing-drop drop-formation waveforms 97 can also vary in the number of secondary pulses 156.

Similarly, the first-set and the second-set drop-formation waveforms can each include more than one non-printing large-drop drop-formation waveform 92 to accommodate different printing/non-printing sequences. The plurality of non-printing large-drop drop-formation waveforms 92 can vary in the duty cycles and onset times of the primary pulses 154 or of the secondary pulses 156. The different non-printing large-drop drop-formation waveforms 92 can also vary in the number of secondary pulses 156.

In some embodiments, the first and second sets of drop-formation waveforms each include eight drop-formation waveforms (labeled A-H), and the selection of the drop-formation waveform for the $k^{th}$ time interval in the waveform sequence depends not only on the printing/non-printing state of time interval k but also on the printing/non-printing states of preceding and following time intervals k−1 and k+1, respectively, as indicated by the table below.

| Printing State | | | Drop-Formation |
|---|---|---|---|
| k | k − 1 | k + 1 | Waveform |
| Printing | Printing | Printing | A |
| Printing | Printing | Non-printing | B |
| Printing | Non-printing | Printing | C |
| Printing | Non-printing | Non-printing | D |
| Non-printing | Printing | Printing | E |
| Non-printing | Printing | Non-printing | F |
| Non-printing | Non-printing | Printing | G |
| Non-printing | Non-printing | Non-printing | H |

Figure 12:
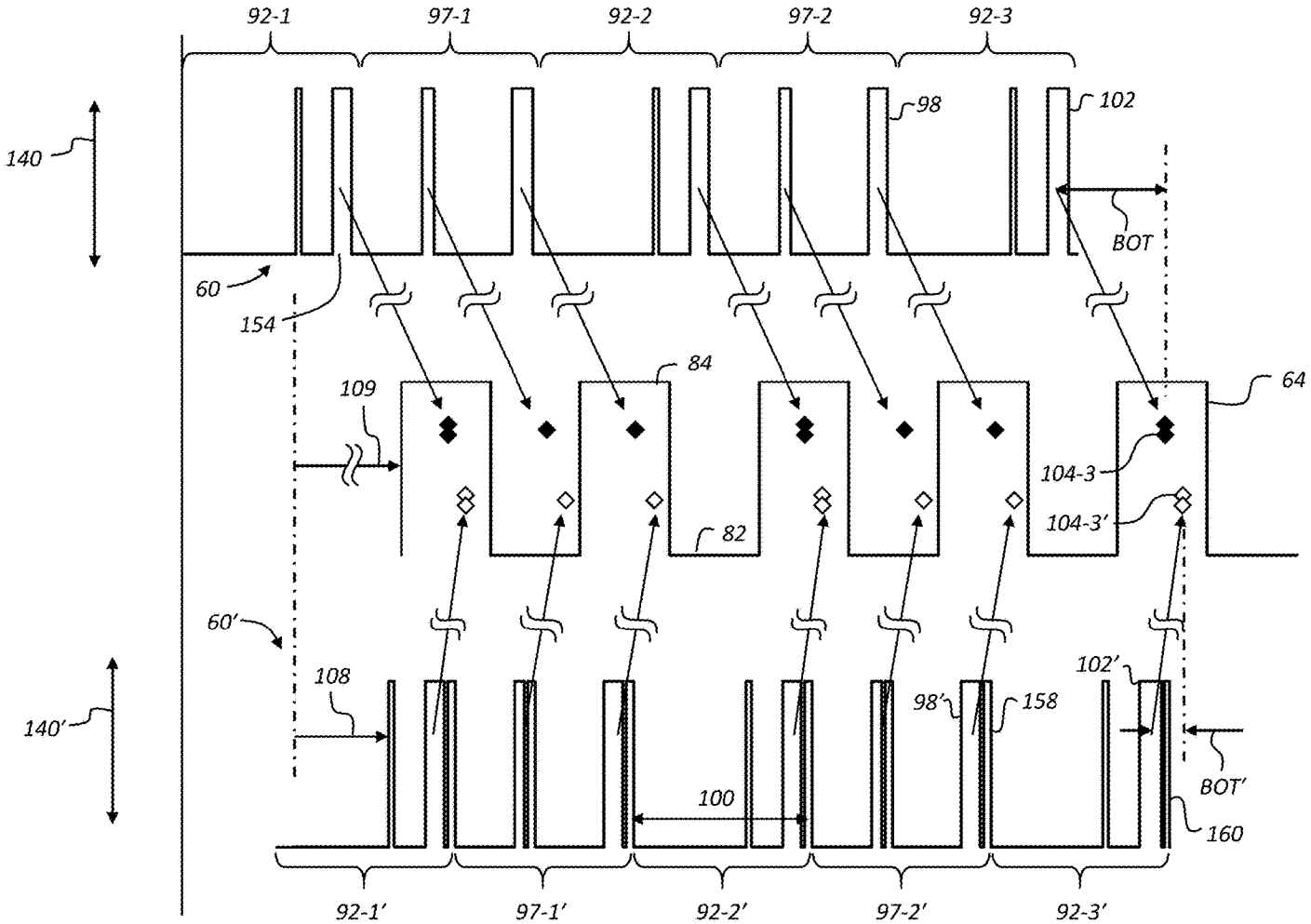
FIG. 12 shows a timing diagram illustrating drop formation pulses applied to two groups of drop formation transducers, where the drop-formation waveforms associated with the second group have more drop formation pulses than the drop-formation waveforms associated with the first group.

When consecutive heater pulses are supplied to the drop-formation heater 51 having a time separation between the pulses that is less than the thermal response time of the drop-formation heater 51, these heater pulses act on the liquid stream 52 as if a single heater pulse were applied to the drop-formation heater 51, as noted in commonly-assigned U.S. Pat. No. 8,087,740. FIG. 12 shows an embodiment in which the increased waveform energy of the drop-formation waveforms in the second drop-formation waveform sequence 60' is provided by the adding additional pulses to the drop-formation waveforms, wherein the additional pulses are separated in time from the primary drop-formation pulses by less than the thermal response time of the drop-formation heater 51. For example, in the printing-drop drop-formation waveform 97-2', an additional pulse 158 follows immediately after the primary drop-formation pulse 98' to effectively add more waveform energy to that drop-formation pulse. Similarly, in large-drop drop-formation waveform 92-3', an additional pulse 160 follows immediately after the primary drop-formation pulse 102' to effectively add more waveform energy to that drop-formation pulse.

Figure 13:
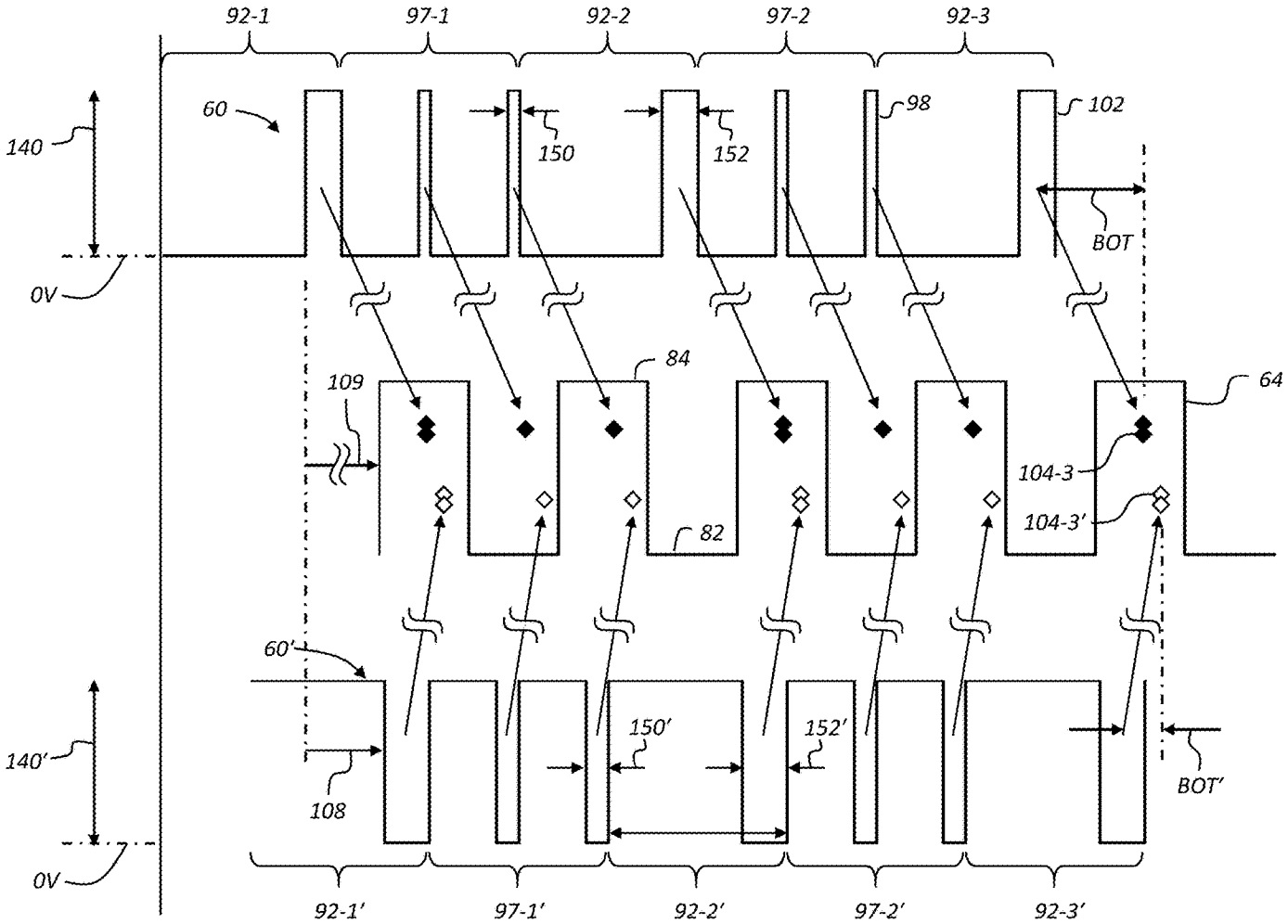
FIG. 13 shows a timing diagram illustrating drop formation pulses applied to two groups of drop formation transducers, where the drop-formation waveforms associated with the second group have inverted drop formation pulses.

Another embodiment is shown in FIG. 13. In this embodiment, the first-set waveforms in the drop-formation waveform sequence 60 are similar to those in FIG. 9. These first-set waveforms are normally held at a low value (e.g., zero volts), with pulses that rise to some higher potential to produce heat pulses that induce the formation of drops. The second-set waveforms in the drop-formation waveform sequence 60' differ in that the waveform potential is normally held at a non-zero voltage, with pulses that fall downward to a lower potential (e.g., to zero volts). Such downward pulses produce a temporary reduction in the energy provided to the drop-formation device or heater 51. These temporary reductions in the energy provided to the drop-formation device can be considered to be "cooling pulses" rather than heating pulses. Such cooling pulses act on the liquid stream in a manner similar to that of heating pulses to induce the formation of drops. As with the normal drop-formation waveforms, such inverted drop-formation waveforms have an associated waveform energy. With the inverted drop-formation waveforms, the waveform energy of the printing drop-formation waveform shall refer to the energy level of the Fourier components of the drop-formation waveform at the frequency appropriate for the modulating the liquid stream to form the pair of small drops and the waveform energy of a non-printing drop-formation waveform shall refer to the energy level of the Fourier components of the drop-formation waveform at the frequency appropriate for the modulating the liquid stream to form the larger non-printing drop. In this embodiment, the increased waveform energy of the second-set waveforms is provided by the cooling pulses having a larger pulse width 152' than the pulse width 152 of the heating pulses of the first-set waveforms. In the illustrated configuration, the second-set waveforms include an inverted waveform pulse which reduces an energy provided by the drop-formation device. In other embodiments, the first-set waveforms can include inverted waveform pulses which reduce the energy provided by the drop-formation device. In still other embodiments, both the first-set and the second-set waveforms include inverted waveform pulses.

As the drop break off phase can vary depending not only on the waveform energy of the drop-formation waveforms, but also dependent on nozzle size, ink pressure and ink properties, some printhead embodiments also include a drop break-off phase detector (not shown) for determining the phase at which drops break off from the first group G1 of nozzles 50 and from the second group G2 of nozzles 50. A variety of drop break-off phase detectors are known in the art, such as are disclosed in U.S. Pat. Nos. 3,761,941, 4,616,234, 7,249,828 and 3,836,912, each of which is incorporated herein by reference. Using such a drop break-off phase detector, the drop break-off phase difference between the drops from the first group G1 of nozzles 50 and the drops from the second group G2 of nozzles 50 can be determined. As discussed above, this phase difference is produced by both the second-group time shift 108 (FIG. 8) between the first-set waveforms and the second-set waveforms and the waveform energy difference between the first-set waveforms and the second-set waveforms. To maximize the latitude for setting the phase of the charging-electrode waveform relative to the drop-formation waveforms, it is desirable that the drop break-off time difference or phase difference between the drops from the first group G1 of nozzles 50 and the drops from the second group G2 of nozzles 50 be kept small. The drop break-off time difference can be adjusted by adjusting either the second-group time shift 108 applied by group timing delay device 134 (FIG. 7) or the waveform energy of the drop-formation waveforms. As it is typically simpler to adjust the second-group time shift 108 than it is to adjust the waveform energy, in some embodiments the time shift 108 is adjusted responsive to the measured drop break-off time difference to minimize the drop break-off time difference.

Figure 14:
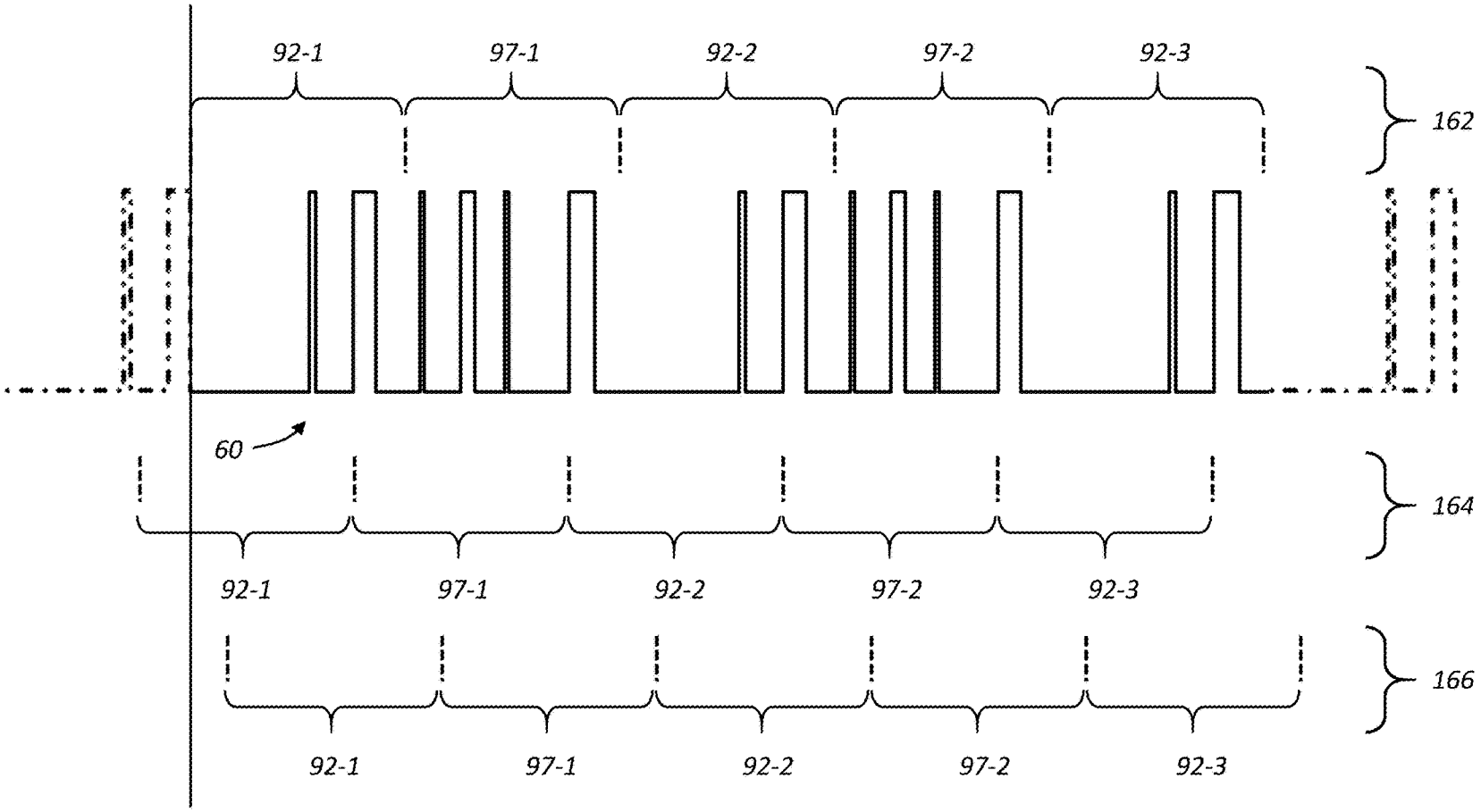
FIG. 14 shows a timing diagram of a sequence of drop-formation waveforms, illustrating flexibility in defining the start and end points of each waveform.

FIG. 14 shows a portion of a sequence of drop-formation waveforms, the portion including three non-printing large-drop drop-formation waveforms 92-1, 92-2, 92-3 and two printing-drop drop-formation waveforms 97-1, 97-2. As indicated by the different three boundary sets 162, 164, 166 of brackets and waveform break marks, the boundaries between the drop-formation waveforms can be shifted within a range while still retaining the required drop-formation pulses within the printing-drop drop-formation waveforms 97-1, 97-2 for the creation of a printing drop and a non-printing drop, and retaining the required drop-formation pulse for the creation of a large non-printing drop in the large-drop drop-formation waveforms 92-1, 92-2, 92-3.

Figure 15:
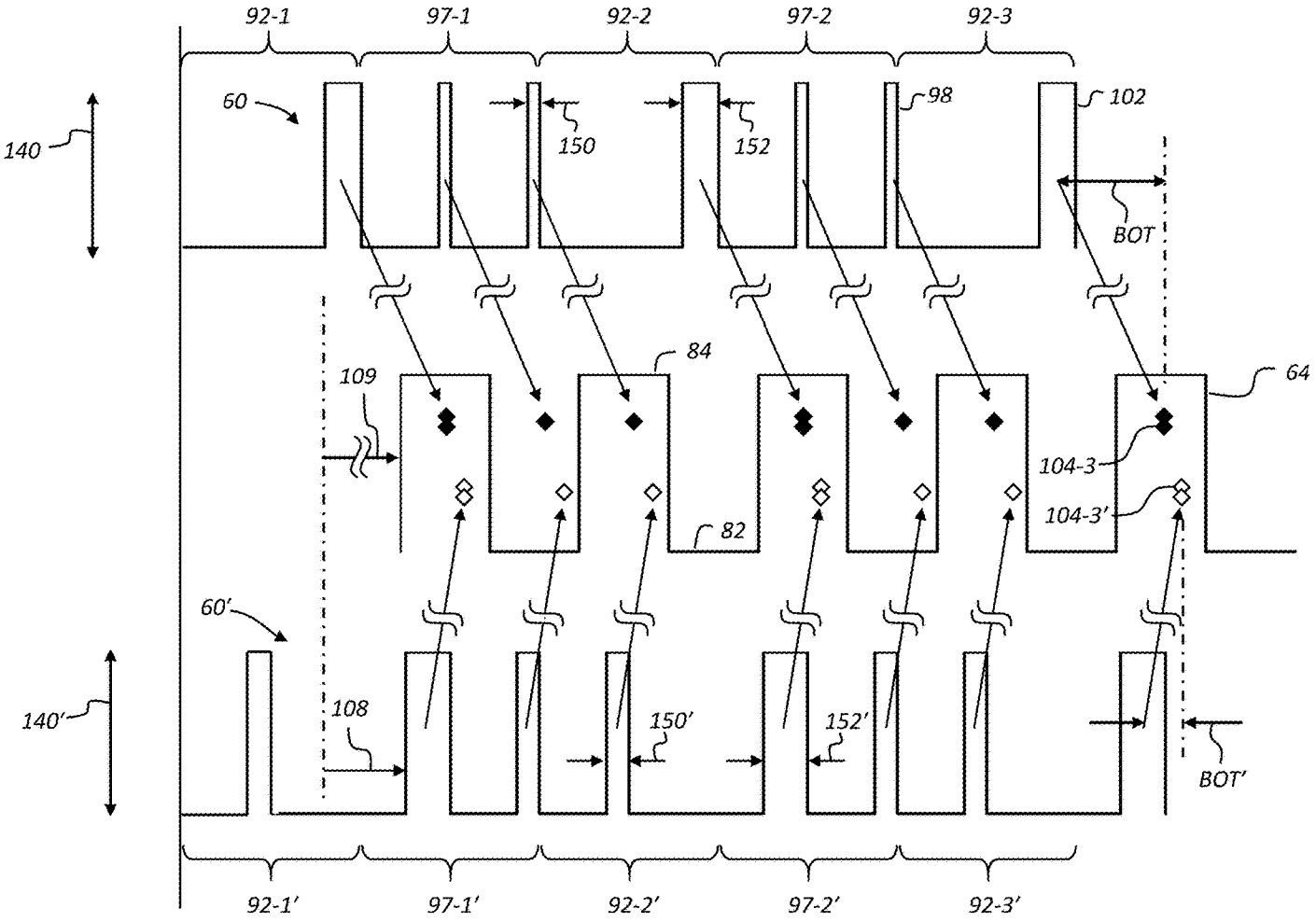
FIG. 15 shows a timing diagram illustrating drop formation pulses applied to two groups of drop formation transducers, where the time delay for the second group is introduced by shifting the drop-formation pulses within the boundaries of the drop-formation waveforms.

In the embodiment of FIG. 15, the placement of the waveform boundaries of the second set waveforms in the drop-formation waveform sequence 60' has been shifted relative to the drop formation pulses within the waveforms. (While the trailing edge boundaries of the large-drop drop-formation waveform 92-1, 92-2, 92-3 are aligned with the falling edge of the drop formation pulses 102 and the trailing edge boundaries of the printing-drop drop-formation waveform 97-1, 97-2 are aligned with the falling edge of one of the drop formation pulses 98 in the first-set waveforms in the drop-formation waveform sequence 60, the boundaries have been shifted from those locations in the second-set of waveforms in the drop-formation waveform sequence 60'. As a result of the shifts in the waveform boundaries it is still possible to have a second group time shift 108 even though the waveform boundaries of the first set and the second-set waveforms are aligned. The group timing delay device 134 therefore does not need to delay the second group trigger pulses relative to the first group trigger pulses to effectively delay the phase of the second-set waveforms relative to the first-set waveforms. Rather, the "time shift" is embodied in the set of drop-formation waveforms in order to provide the phase control means.

Figure 16:
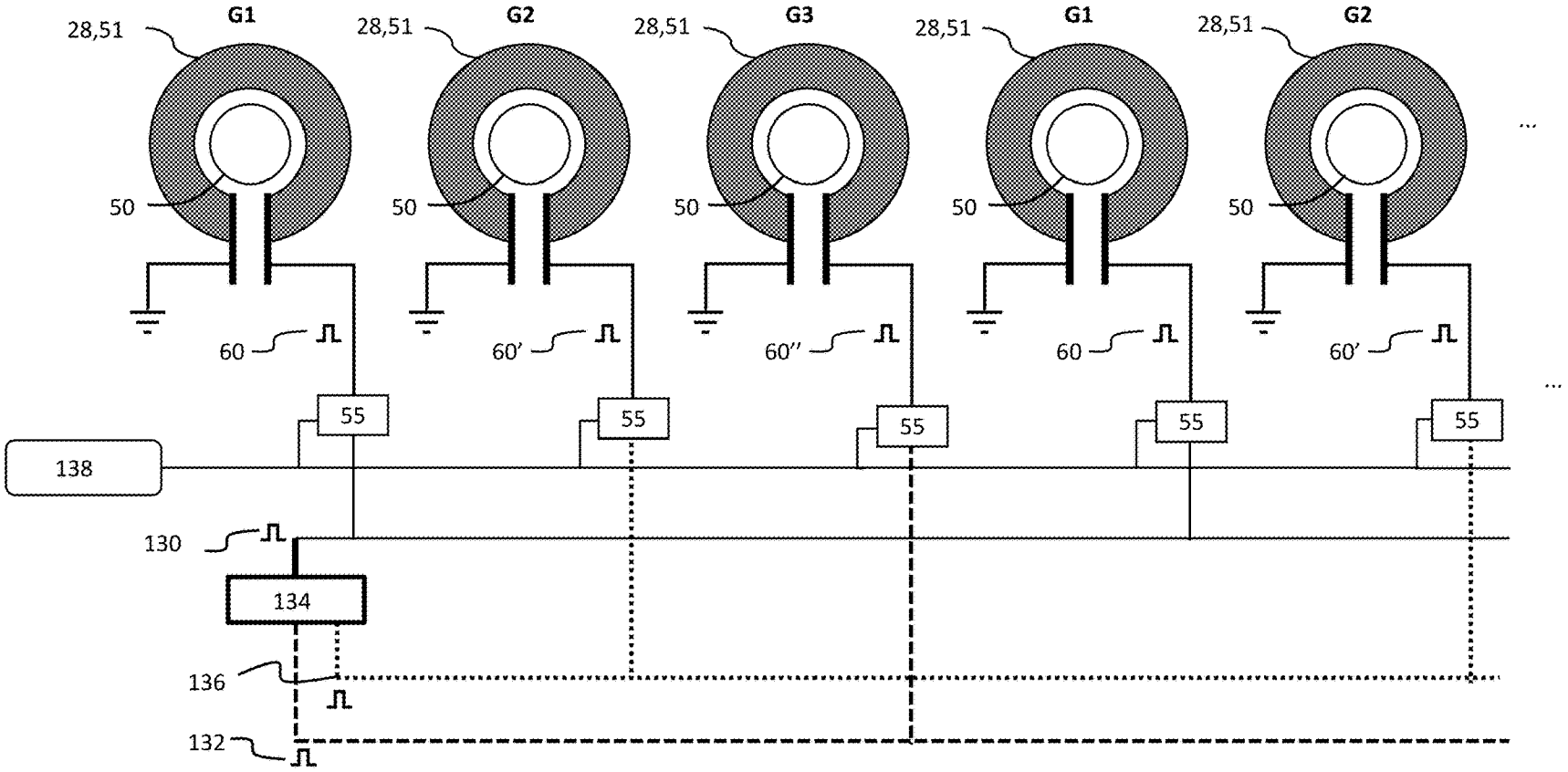
FIG. 16 is a simplified block schematic diagram of four adjacent nozzles arranged into three groups and associated drop formation devices according to another exemplary embodiment.

In the embodiment of FIG. 16, the plurality of nozzles 50 are arranged or grouped into three nozzle groups. The nozzle groups include a third group G3 of nozzles 50 in addition to the first group G1 and the second group G2. The nozzles 50 of the third group G3 are interleaved with nozzles of the first group G1 and the second group G2. Between any two first group nozzles there is a second group nozzle and a third group nozzle. Similarly, between any two second group nozzles there is a first group nozzle and a third group nozzle, and between any two third group nozzles there is a first group nozzle and a second group nozzle. Each of the nozzles 20 has an associated drop-formation device (e.g., a heater 51). For brevity, the drop-formation device associated with a nozzle of the third group G3 will be referred to as a third-group drop-formation device. The drop-formation waveforms supplied to the third group drop-formation devices are referred to as third group waveforms.

A timing delay device 134 supplies a first group trigger pulse 130 to control the starting time of the first-group waveforms in the drop-formation waveform sequence 60, a second group trigger pulse 132 to control the starting time of the second-set waveforms in the drop-formation waveform sequence 60', and a third group trigger pulse 136 to control the starting time of the third-group waveforms in the drop-formation waveform sequence 60". The timing delay device 134 is a particular example of a phase control means which controls the relative phase of the waveforms supplied to the first and second groups of nozzles.

Figure 17:
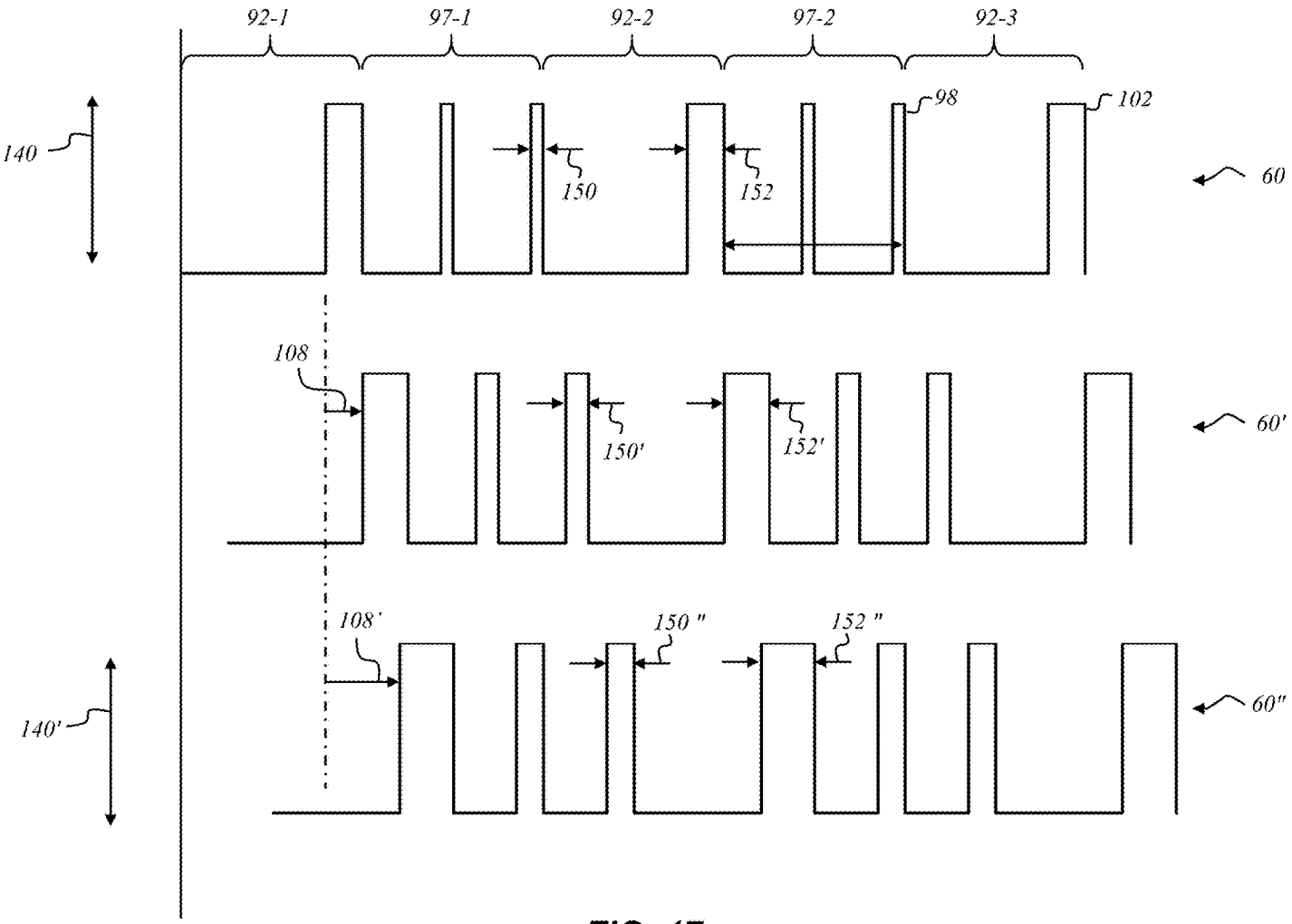
FIG. 17 shows a timing diagram illustrating drop formation pulses applied to three groups of drop formation transducers, where the drop formation pulses applied to the second group are time delayed relative and have a higher waveform energy relative to the drop formation pulses applied to the first group, and the drop formation pulses applied to the third group are time delayed and have a higher waveform energy relative to the drop formation pulses applied to the second group.

In an exemplary embodiment, the timing delay device 134 shifts the timing of the different groups so that the pulses in the first-group waveforms precede corresponding pulses in the second-group waveforms by a time shift 108 and precede the corresponding pulses in the third-group waveforms by a time shift 108' which is larger than time shift 108, as indicated in FIG. 17. The second-group waveforms in the drop-formation waveform sequence 60' therefore precede the third-group waveforms in the drop-formation waveform sequence 60".

In addition, the pulse widths 150", 152" for the third-group waveforms are increased relative to the pulse widths 150', 152' of the second-group waveforms so that the waveform energies of the third-group waveforms in the drop-formation waveform sequence 60" are increased relative to the waveform energies of the of the second-group waveforms 60'. This causes the break-off times BOT" of the drops from the third group G3 of nozzles 50 to be less than the break-off times BOT' of the drops from the second group G2 of nozzles 50, which in turn is less than the break-off times BOT of the drops from the first group G1 of nozzles 50. As with the previous embodiments, the waveform energies of the second-group waveforms are increased relative to the waveform energies of the of the first-group waveforms so that the break-off times BOT' of the drops from the second group G2 of nozzles 50 are less than the break-off times BOT of the drops from the first group G1 of nozzles 50.

The printing drops are relatively uncharged when compared to the charge of either the small or the large non-printing drops. But even a small amount of charge on the printing drops can cause the printing drops to undergo some drop deflection, altering the position at which they impact the print medium. To ensure the highest quality print, it is desirable to ensure that the printing drops have a consistent drop charge. As the charge on the printing drops is influenced by the charge on the preceding drops, some embodiments require each pair of drops formed by a printing-drop drop-formation waveform 97 to be preceded by a large non-printing drop. As the trajectory of the printing drops can be influenced by the drop-to-drop electrostatic and aerodynamic interactions, some embodiments require each pair of drops formed by a printing-drop drop-formation waveform 97 to be followed by a large non-printing drop.

While each of the preceding embodiments have involved drop-formation waveforms made up of a set of one or more waveform pulses, the drop-formation waveforms are not limited to such sets of waveform pulses. Other waveforms such as sinusoidal, triangular, chirp waveforms, or portions or combinations thereof may also be used.

The preceding embodiments have described the timing delay device 134 as producing a first group trigger pulse 130 and a second group trigger pulse 132 for controlling the timing of the first-set waveforms relative to the second-set waveforms. In alternate embodiments, the timing delay device 134 can use other timing control configurations that do not involve using separate trigger pulses for controlling the timing of the different groups of drop-formation devices. For example, the second-set waveforms could be delayed by a predefined number of clock pulses relative to first-set waveforms. Furthermore, in certain embodiments, the different drop-formation waveforms in each sequence of waveforms are concatenated together with no breaks between waveforms. In such embodiments, there is no need for a trigger pulse to initiate each waveform. In such embodiments, the group timing delay device can refer to software implementation for delaying the second-set waveforms relative to the first-set waveforms.

Figure 18A:
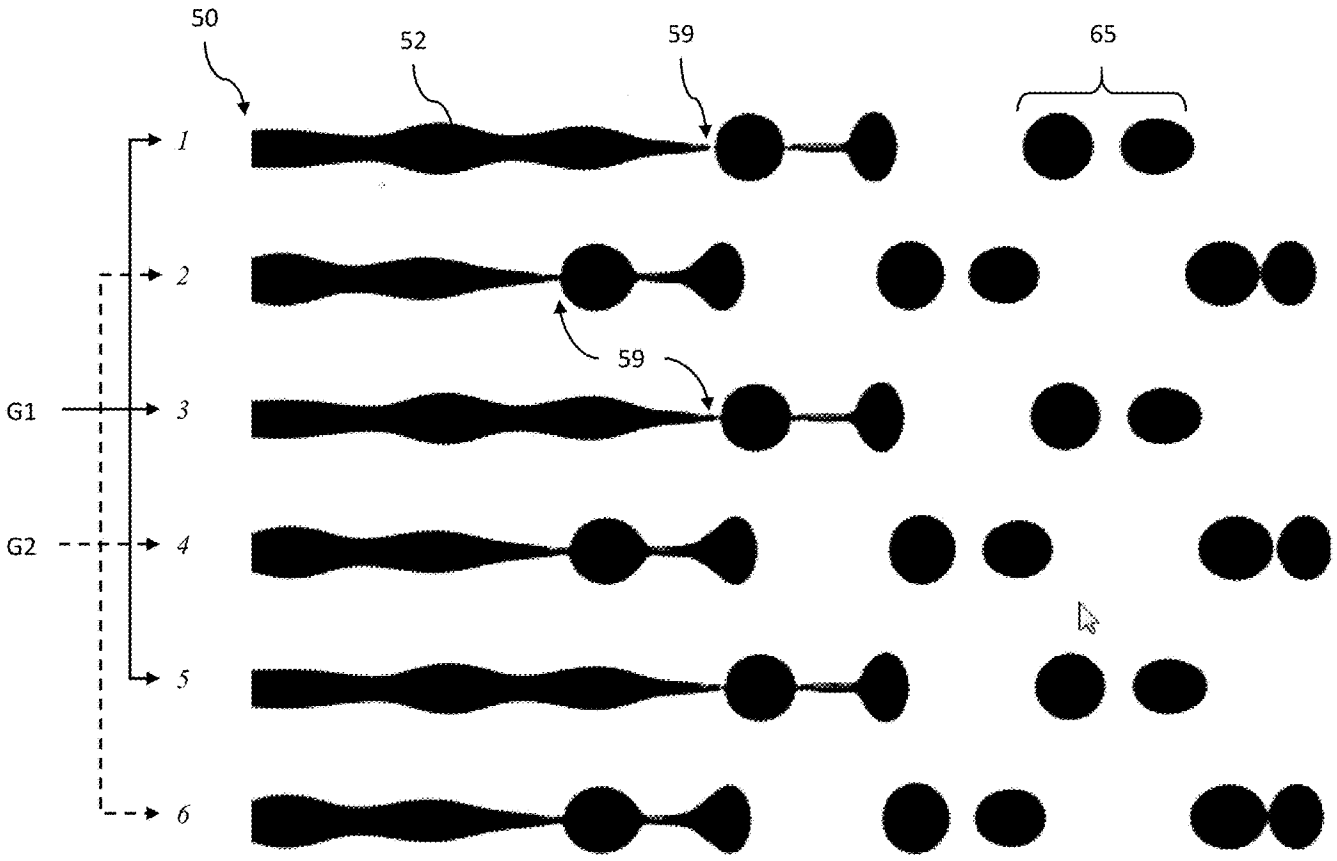
FIGS. 18A-18B are photographs comparing drops being formed with drop-formation waveforms in accordance with the present invention to those being formed with a prior art method.
Figure 18B:
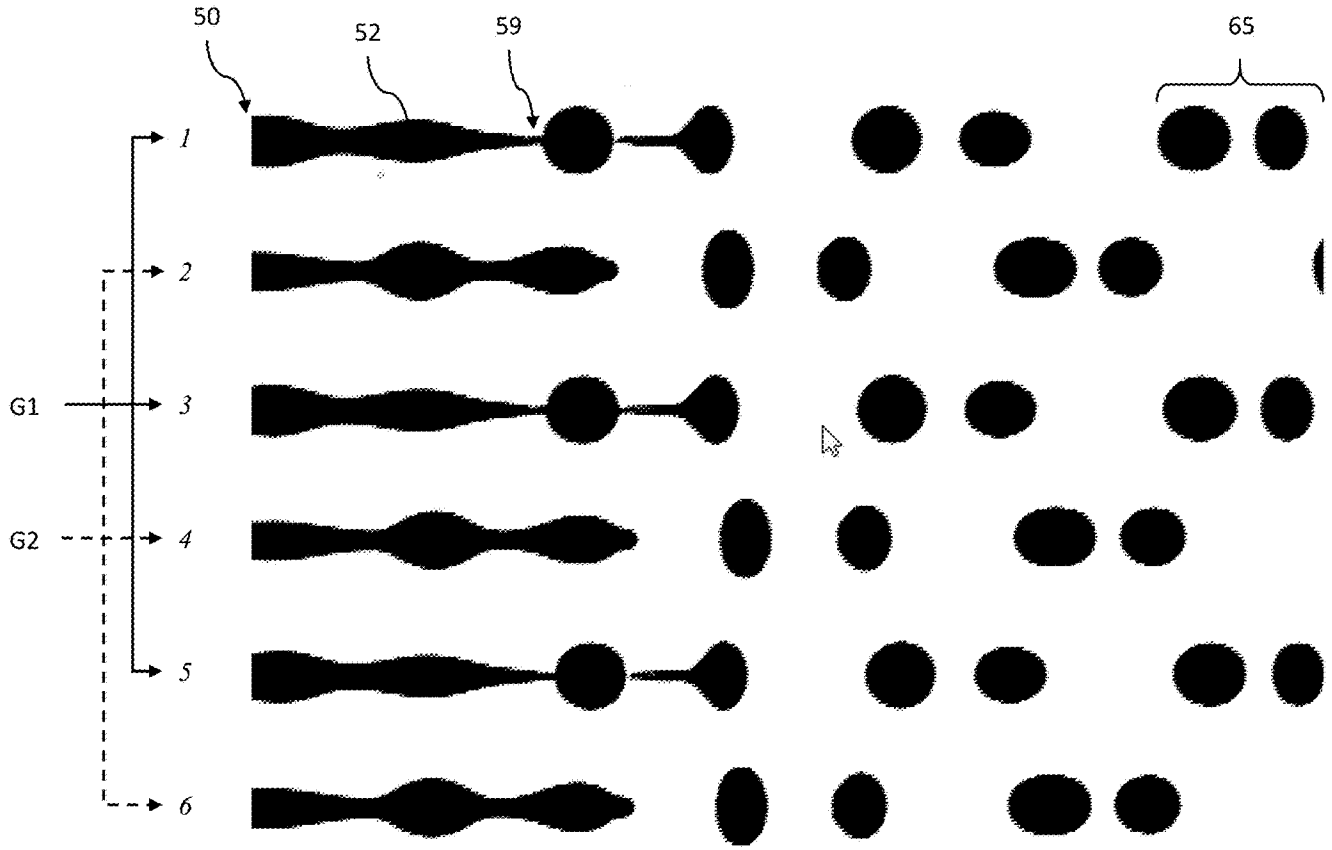

FIG. 18A is a photograph of ink drops being formed in accordance with the present invention. The ink drops being formed in this example are non-printing large drops 65. (The pair of drops has not yet merged into a single large drop 65 at this point in time.) Ink streams 52 are formed through an array of nozzles 50. The odd-numbered nozzles form a first group of nozzles G1, and the even-numbered nozzles 50 form a second group of nozzles G2. The second-group waveforms used to control the second group of nozzles G2 are time-shifted (by one half of the waveform period) and have a higher waveform energy relative to the first-group waveforms used to control the first group of nozzles G1. It can be seen that at the instant of time where the photograph was captured, drops are breaking off at breakoff locations 59 for both the first and second groups of nozzles. As a result, the resulting large drops 65 will all have the same charge state. In contrast, FIG. 18B shows the results obtained without the method of the present invention. In this case, the phase of the second-group waveforms has been shifted by 180 degrees, but the same waveform energy is used. It can be seen that the drops are breaking off at the breakoff location 59 for the first group of nozzles G1, but the drops being formed by the second group of nozzles G2 are not close to break-off. As a result, the charge state of the resulting large drops will not be the same.

The invention has been described in detail with particular reference to certain preferred embodiments thereof, but it will be understood that variations and modifications can be effected within the spirit and scope of the invention.

PARTS LIST

20 printing system
22 image source
24 image processing unit
26 control circuits
27 synchronization device
28 drop-forming transducer
30 printhead
32 print medium
34 print medium transport system
35 speed measurement device
36 media transport controller
38 micro-controller
40 ink reservoir
44 ink recycling unit
46 ink pressure regulator
47 ink channel
48 jetting module
49 nozzle plate
50 nozzle
51 heater
52 liquid stream
54 drop
55 drop-formation waveform source
57 trajectory
59 breakoff location
60 drop-formation waveform sequence
60' drop-formation waveform sequence
60" drop-formation waveform sequence
61 charging device
62 charging electrode

62' charging electrode
63 charging-electrode waveform source
64 charging-electrode waveform
65 large drop
**65*a*** drop
**65*b*** drop
66 printing drop
68 non-printing drop
69 drop selection system
70 deflection mechanism
71 deflection electrode
72 ink catcher
74 catcher face
76 ink film
78 liquid channel
79 lower plate
80 charging-electrode waveform period
82 first voltage state
84 second voltage state
86 non-print trajectory
88 print dot
92 large-drop drop-formation waveform
92-1 large-drop drop-formation waveform
92-1' large-drop drop-formation waveform
92-2 large-drop drop-formation waveform
92-2' large-drop drop-formation waveform
92-3 large-drop drop-formation waveform
92-3' large-drop drop-formation waveform
94 small-drop drop-formation waveform
94-1 small-drop drop-formation waveform
94-2 small-drop drop-formation waveform
94-3 small-drop drop-formation waveform
94-4 small-drop drop-formation waveform
96 period
97 printing-drop drop-formation waveform
97-1 printing-drop drop-formation waveform
97-1' printing-drop drop-formation waveform
97-2 printing-drop drop-formation waveform
97-2' printing-drop drop-formation waveform
98 pulse
98' pulse
99 arrows
100 period
102 pulse
102' pulse
104 large drop
104-1 large drop
104-1' large drop
104-2 large drop
104-2' large drop
104-3 large drop
104-3' large drop
104-3" large drop
106-1 small drop
106-1' small drop
106-2 small drop
106-2' small drop
106-3 small drop
106-3' small drop
106-4 small drop
106-4' small drop
108 time shift
108' time shift
109 phase shift
110 periodic pattern
120 stroke
122 space
124 diffuse region
125 spatial period
130 first group trigger pulse
132 second group trigger pulse
134 timing delay device
136 third group trigger pulse
140 amplitude
140' amplitude
144 outer diameter
144' outer diameter
150 pulse width
150' pulse width
150" pulse width
152 pulse width
152' pulse width
152" pulse width
154 primary pulse
156 secondary pulse
158 additional pulse
160 additional pulse
162 boundary set
164 boundary set
166 boundary set

The invention claimed is:

1. A method of printing, comprising:

providing a liquid chamber having a plurality of nozzles disposed along a nozzle array direction, the plurality of nozzles including a first group of nozzles and a second group of nozzles, the nozzles of the first group being interleaved with the nozzles of the second group;

providing liquid under pressure in the liquid chamber, the pressure being sufficient to eject liquid jets through the plurality of nozzles;

providing a drop-formation device associated with each of the plurality of nozzles;

providing a first set of drop-formation waveforms and a second set of drop-formation waveforms, wherein the first set of drop-formation waveforms and the second set of drop-formation waveforms each include:

one or more printing-drop drop-formation waveforms having a waveform period, which, when supplied to a drop-formation device associated with a particular nozzle, modulate the liquid jet ejected from the particular nozzle to selectively cause portions of the liquid jet to break off into a pair of drops traveling along a path, the pair of drops including a small printing drop and a small non-printing drop; and one or more non-printing-drop drop-formation waveforms, which, when supplied to a drop-formation device associated with a particular nozzle, modulate the liquid jet ejected from the particular nozzle to selectively cause a portion of the liquid jet to break off into a large non-printing drop traveling along the path, the large non-printing drop being larger than the small printing drop and the small non-printing drop, the non-printing-drop drop-formation waveforms having the same waveform period as the printing-drop drop-formation waveforms;

wherein each of the drop-formation waveforms provides an associated waveform energy when supplied to the corresponding drop-formation device, and wherein the waveform energies associated with the drop-formation waveforms in the second set of drop-formation waveforms is larger than the waveform energies associated with the corresponding drop-formation waveforms in the first set of drop-formation waveforms;

providing input image data;

controlling the drop-formation devices associated with each of the plurality of nozzles in response to the provided input image data, wherein the first group of nozzles are controlled with a sequence of drop-formation waveforms selected from the first set of drop-formation waveforms and the second group of nozzles are controlled with a sequence of drop-formation waveforms selected from the second set of drop-formation waveforms;

providing a timing delay device to time-shift the drop-formation waveforms used to control the drop-formation devices associated with the second group of nozzles by a specified second-group time shift relative to the drop-formation waveforms used to control the drop-formation devices associated with the first group of nozzles, wherein the second-group time shift is a fraction of the waveform period;

providing a charging device including:

a common charging electrode positioned in proximity to the liquid jets ejected rough both the first and second groups of nozzles; and a charging-electrode waveform source providing a varying electrical potential between the charging electrode and the liquid jets according to a predefined periodic charging-electrode waveform, the charging-electrode waveform including a first portion providing a first electrical potential and a second portion providing a second electrical potential, wherein the charging-electrode waveform has the same waveform period as the drop-formation waveforms;

synchronizing the drop-formation devices, the timing delay device, and the charging device, wherein the waveform energies associated with the drop-formation waveforms in the first and second sets of drop-formation waveforms and the second-group time shift are selected such that the small printing drops break off from the liquid jets during the first portion of the charging-electrode waveform to provide a first printing-drop charge state, and the small non-printing drops and the large non-printing drops break off from the liquid jets during the second portion of the charging-electrode waveform to provide a second non-printing-drop charge state;

providing a deflection device which causes the printing drops having the first printing-drop charge state to travel along a different path from the non-printing drops having the second non-printing-drop charge state; and intercepting the non-printing drops using an ink catcher while allowing the printing drops to travel along a path toward a receiver.

2. The method of claim 1, wherein each of the drop-formation waveforms in the first and second sets of drop-formation waveforms includes one or more waveform pulses.

3. The method of claim 2, wherein the amplitude of the waveform pulses in the second set of drop-formation waveforms is larger than the amplitude of the waveform pulses in the first set of drop-formation waveforms.

4. The method of claim 2, wherein each waveform pulse in the second set of drop-formation waveforms corresponds to a waveform pulse in the first set of drop-formation waveforms.

5. The method of claim 4, wherein at least one of the waveform pulses in each of the drop-formation waveforms in the second set of drop-formation waveform has a greater pulse width than the corresponding waveform pulse in the corresponding drop-formation waveform in the first set of drop-formation waveforms.

6. The method of claim 4, wherein at least one of the waveform pulses in each of the drop-formation waveforms in the second set of drop-formation waveforms has an equal pulse width to the corresponding waveform pulse in the corresponding drop-formation waveform in the first set of drop-formation waveforms.

7. The method of claim 2, wherein at least one of the drop-formation waveforms in the second set of drop-formation waveforms includes more waveform pulses than the corresponding drop-formation waveform in the first set of drop-formation waveforms.

8. The method of claim 2, wherein at least one of the drop-formation waveforms includes an inverted waveform pulse which reduces an energy provided by the drop-formation device.

9. The method of claim 1, wherein each of the drop-formation devices includes a heater having a heater resistance, and wherein the heater resistance of the heaters in the drop-formation devices associated with the first group of nozzles is higher than the heater resistance of the heaters in the drop-formation devices associated with the second group of nozzles.

10. The method claim 1, wherein the second-group time shift is in the range of ¼ to ¾ of the waveform period.

11. The method of claim 1, further comprising a detector for detecting time differences between break-off times of drops formed by the first group of nozzles and break-off times of corresponding drops formed by the second group of nozzles.

12. The method of claim 11, wherein the second-group time shift is adjusted responsive to the detected time differences.

13. The method of claim 1, wherein each drop-formation device includes a drop-formation transducer, and wherein the drop-formation transducer is a thermal device, a piezoelectric device, a MEMS actuator, an electrohydrodynamic device, an optical device or an electrostrictive device.

14. The method of claim 1, wherein the plurality of nozzles also includes a third group of nozzles, the nozzles of the third group being interleaved with the nozzles of the first group and the nozzles of the second group, and wherein the timing delay device time-shifts a third set f drop-formation waveforms used to control the drop-formation devices associated with the third group of nozzles by a specified third-group time shift, the third-group time shift being different from the second-group time shift, and wherein waveform energies associated with the drop-formation waveforms in the third set of drop-formation waveforms is different from than the waveform energies associated with the corresponding drop-formation waveforms in the first and second sets of drop-formation waveforms.

15. The method of claim 1, wherein the large non-printing drops are formed by merging two or more drops.

16. The method of claim 1, wherein the first printing-drop charge state of the printing drops has a lower charge than the second non-printing-drop charge state of the non-printing drops.

17. The method of claim 1, wherein the printing drops are uncharged.

18. The method of claim 1, wherein the pair of drops formed by the printing-drop drop-formation waveforms is preceded or followed by a large non-printing drop.

19. A method of printing, comprising:

providing a liquid chamber having a plurality of nozzles disposed along a nozzle array direction, the plurality of nozzles including a first group of nozzles and a second group of nozzles, the nozzles of the first group being interleaved with the nozzles of the second group;

providing liquid under pressure in the liquid chamber, the pressure being sufficient to eject liquid jets through the plurality of nozzles;

providing a drop-formation device associated with each of the plurality of nozzles;

providing a first set of drop-formation waveforms and a second set of drop-formation waveforms, wherein the first set of drop-formation waveforms and the second set of drop-formation waveforms each include:

one or more printing-drop drop-formation waveforms having a waveform period, which, when supplied to a drop-formation device associated with a particular nozzle, modulate the liquid jet ejected from the particular nozzle to selectively cause portions of the liquid jet to break off into a pair of drops traveling along a path, the pair of drops including a small printing drop and a small non-printing drop; and one or more non-printing-drop drop-formation waveforms, which, when supplied to a drop-formation device associated with a particular nozzle, modulate the liquid jet ejected from the particular nozzle to selectively cause a portion of the liquid jet to break off into a large non-printing drop traveling along the path, the large non-printing drop being larger than the small printing drop and the small non-printing drop, the non-printing-drop drop-formation waveforms having the same waveform period as the printing-drop drop-formation waveforms;

wherein each of the drop-formation waveforms provides an associated waveform energy when supplied to the corresponding drop-formation device, and wherein the waveform energies associated with the drop-formation waveforms in the second set of drop-formation waveforms is larger than the waveform energies associated with the corresponding drop-formation waveforms in the first set of drop-formation waveforms;

providing input image data;

controlling the drop-formation devices associated with each of the plurality of nozzles in response to the provided input image data, wherein the first group of nozzles are controlled with a sequence of drop-formation waveforms selected from the first set of drop-formation waveforms and the second group of nozzles are controlled with a sequence of drop-formation waveforms selected from the second set of drop-formation waveforms;

providing a phase control means for controlling a phase of the drop-formation waveforms used to control the drop-formation devices associated with the second group of nozzles such that the phase is shifted by a second-group phase shift relative to the drop-formation waveforms used to control the drop-formation devices associated with the first group of nozzles, wherein the second-group phase shift is a fraction of the waveform period;

providing a charging device including:

a common charging electrode positioned in proximity to the liquid jets ejected through both the first and second groups of nozzles; and a charging-electrode waveform source providing a varying electrical potential between the charging electrode and the liquid jets according to a predefined periodic charging-electrode waveform, the charging-electrode waveform including a first portion providing a first electrical potential and a second portion providing a second electrical potential, wherein the charging-electrode waveform has the same waveform period as the drop-formation waveforms;

synchronizing the drop-formation devices, the phase control means, and the charging device, wherein the waveform energies associated with the drop-formation waveforms in the first and second sets of drop-formation waveforms and the second-group phase shift are selected such that the small printing drops break off from the liquid jets during the first portion of the charging-electrode waveform to provide a first printing-drop charge state, and the small non-printing drops and the large non-printing drops break off from the liquid jets during the second portion of the charging-electrode waveform to provide a second non-printing-drop charge state;

providing a deflection device which causes the printing drops having the first printing-drop charge state to travel along a different path from the non-printing drops having the second non-printing-drop charge state; and intercepting the non-printing drops using an ink catcher while allowing the printing drops to travel along a path toward a receiver.

20. The method of claim 19, wherein the phase control means is a timing delay device which time-shifts the drop-formation waveforms used to control the drop-formation devices associated with the second group of nozzles by a specified second-group time shift relative to the drop-formation waveforms used to control the drop-formation devices associated with the first group of nozzles.

21. The method of claim 19, wherein the drop-formation waveforms have waveform boundaries and include one or more waveform pulses, and wherein the phase control means modifies the drop-formation waveforms supplied to the drop-formation devices associated with the second group of nozzles by shifting positions of waveform boundaries relative to positions of the waveform pulses.

* * * * *